US011532279B2

(12) United States Patent
Kwon et al.

(10) Patent No.: US 11,532,279 B2
(45) **Date of Patent: *Dec. 20, 2022**

(54) ORGANIC LIGHT EMITTING DIODE DISPLAY DEVICE PERFORMING LOW FREQUENCY DRIVING

(71) Applicant: Samsung Display Co., Ltd., Yongin-Si (KR)

(72) Inventors: Sangan Kwon, Cheonan-si (KR); Hyojin Lee, Yongin-si (KR); Jinyoung Roh, Hwaseong-si (KR); Sehyuk Park, Seongnam-si (KR)

(73) Assignee: Samsung Display Co., Ltd.

( * ) Notice: Subject to any disclaimer, the term of this patent is extended or adjusted under 35 U.S.C. 154(b) by 0 days.

This patent is subject to a terminal disclaimer.

(21) Appl. No.: 17/190,962

(22) Filed: Mar. 3, 2021

(65) Prior Publication Data

US 2021/0193054 A1 Jun. 24, 2021

Related U.S. Application Data

(63) Continuation of application No. 16/923,008, filed on Jul. 7, 2020, now Pat. No. 10,971,077.

(30) Foreign Application Priority Data

Jul. 31, 2019 (KR) ..... 10-2019-0093149

(51) Int. Cl.
*G09G 5/10* (2006.01)
*G09G 3/3275* (2016.01)
(Continued)

(52) U.S. Cl.
CPC ..... *G09G 3/3275* (2013.01); *G09G 3/2007* (2013.01); *G09G 3/3233* (2013.01);
(Continued)

(58) Field of Classification Search
CPC ..... G09G 2320/0257; G09G 2320/103; G09G 2330/021; G09G 2340/0435; G09G 3/3677
See application file for complete search history.

(56) References Cited

U.S. PATENT DOCUMENTS

2009/0122087 A1* 5/2009 Maruyama ..... G09G 3/3611 345/102
2009/0244108 A1* 10/2009 Park ..... G09G 3/204 345/690
2014/0375627 A1 12/2014 Kim et al.

FOREIGN PATENT DOCUMENTS

KR 10-2013-0118459 A 10/2013
KR 10-2016-0022450 A 3/2016

* cited by examiner

*Primary Examiner* — Insa Sadio
(74) *Attorney, Agent, or Firm* — Innovation Counsel LLP

(57) ABSTRACT

An OLED display device includes display panel and a panel driver. The panel driver receives input image data at an input frame frequency and determines whether the input image data represent a still image. When the input image data do not represent the still image, the panel driver drives the display panel at a first output frame frequency substantially equal to the input frame frequency. When the input image data represent the still image, the panel driver drives the display panel at a second output frame frequency lower than the input frame frequency for a low frequency driving time and drives the display panel at a third output frame frequency higher than the second output frame frequency for a high frequency insertion time determined by one of a panel characteristic of the display panel and a representative gray level of the input image data, after the low frequency driving time.

20 Claims, 16 Drawing Sheets

(51) Int. Cl.

| | |
|---|---|
| ***G09G 3/3258*** | (2016.01) |
| ***G09G 3/3233*** | (2016.01) |
| ***G09G 3/20*** | (2006.01) |

(52) U.S. Cl.

CPC ... *G09G 3/3258* (2013.01); *G09G 2300/0809* (2013.01); *G09G 2320/0233* (2013.01); *G09G 2320/0247* (2013.01); *G09G 2320/103* (2013.01); *G09G 2330/023* (2013.01)

| GRAY RANGE | HF INSERTION TIME |
|---|---|
| 100G-255G | 1s |
| 30G-99G | 0.5s |
| 0G-29G | 2s |

FIG. 15

| OFF3 | # OF FRAMES |
|---|---|
| 30Hz | 30 FRAMES |
| 10Hz | 10 FRAMES |
| 30Hz | 30 FRAMES |
| 10Hz | 10 FRAMES |

FIG. 19

| GRAY RANGE | HF INSERTION PATTERN |
|---|---|
| 100G-255G | 30Hz -> 10Hz -> 30Hz -> 10Hz |
| 30G-99G | 30Hz -> 10Hz |
| 0G-29G | 30Hz -> 20Hz -> 10Hz |

ORGANIC LIGHT EMITTING DIODE DISPLAY DEVICE PERFORMING LOW FREQUENCY DRIVING

CROSS-REFERENCE TO RELATED APPLICATION(S)

This application is a continuation application of U.S. patent application Ser. No. 16/923,008 filed on Jul. 7, 2020, which claims priority under 35 USC § 119 to Korean Patent Application No. 10-2019-0093149, filed on Jul. 31, 2019 in the Korean Intellectual Property Office (KIPO), the disclosures of which are incorporated herein in their entirety by reference.

BACKGROUND

1. Field

Example embodiments of the present disclosure relate to a display device, and more particularly to an organic light emitting diode (OLED) display device performing low frequency driving.

2. Description of the Related Art

Reduction of power consumption is desirable in an organic light emitting diode (OLED) display device employed in a portable device, such as a smartphone, a tablet computer, etc. Recently, in order to reduce the power consumption of the OLED display device, a low frequency driving technique which drives or refreshes a display panel at a frequency lower than an input frame frequency of input image data has been developed.

However, in an OLED display device using the low frequency driving technique, a threshold voltage of a driving transistor of each pixel may be shifted by the low frequency driving. Further, by the threshold voltage shift, luminance of the OLED display device may be deteriorated, and a flicker may occur.

SUMMARY

Some example embodiments provide an organic light emitting diode (OLED) display device capable of reducing or preventing luminance deterioration while performing low frequency driving.

According to example embodiments, there is provided an OLED including a display panel including a plurality of pixels each having an OLED, and a panel driver configured to drive the display panel. The panel driver receives input image data at an input frame frequency, and determines whether the input image data represent a still image. When the input image data do not represent the still image, the panel driver drives the display panel at a first output frame frequency substantially equal to the input frame frequency. When the input image data represent the still image, the panel driver drives the display panel at a second output frame frequency lower than the input frame frequency for a low frequency driving time, and drives the display panel at a third output frame frequency higher than the second output frame frequency for a high frequency insertion time after the low frequency driving time. The high frequency insertion time is determined based on at least one of a panel characteristic of the display panel and a representative gray level of the input image data.

In example embodiments, a threshold voltage shift of a plurality of driving transistors included in the plurality of pixels which occurs during the low frequency driving time may be compensated during the high frequency insertion time.

In example embodiments, the third output frame frequency may be lower than or equal to the first output frame frequency.

In example embodiments, the high frequency insertion time may be periodically inserted while the still image represented by the input image data is not changed.

In example embodiments, each of the plurality of pixels may include a driving transistor configured to generate a driving current, a switching transistor configured to transfer a data signal to a source of the driving transistor, a compensating transistor configured to diode-connect the driving transistor, a storage capacitor configured to store the data signal transferred through the switching transistor and the diode-connected driving transistor, a first initializing transistor configured to provide an initialization voltage to the storage capacitor and a gate of the driving transistor in response to an initialization signal, a first emission controlling transistor configured to connect a line of a power supply voltage to the source of the driving transistor in response to an emission control signal, a second emission controlling transistor configured to connect a drain of the driving transistor to the OLED in response to the first scan signal, a second initializing transistor configured to provide the initialization voltage to the OLED in response to the first scan signal. The OLED is configured to emit light based on the driving current. At least first one of the driving transistor, the switching transistor, the compensating transistor, the first initializing transistor, the first emission controlling transistor, the second emission controlling transistor and the second initializing transistor may be implemented with a P-type Metal Oxide Semiconductor (PMOS) transistor, and at least second one of the driving transistor, the switching transistor, the compensating transistor, the first initializing transistor, the first emission controlling transistor, the second emission controlling transistor and the second initializing transistor may be implemented with an N-type Metal Oxide Semiconductor (NMOS) transistor.

In example embodiments, each of the plurality of pixels may include a driving transistor configured to generate a driving current, a first switching transistor configured to transfer a data signal, a storage capacitor configured to store the data signal transferred through the first switching transistor, a second switching transistor configured to connect the storage capacitor and the driving transistor to an initialization line, an emission controlling transistor configured to connect a line of a power supply voltage to the driving transistor, and the OLED configured to emit light based on the driving current. At least first one of the driving transistor, the first switching transistor, the second switching transistor and the emission controlling transistor may be implemented with a PMOS transistor, and at least second one of the driving transistor, the first switching transistor, the second switching transistor and the emission controlling transistor may be implemented with an NMOS transistor.

In example embodiments, the panel driver may include a still image detector configured to determine whether the input image data represent the still image by comparing the input image data in a previous frame and the input image data in a current frame.

In example embodiments, the high frequency insertion time may be determined according to, as the panel characteristic of the display panel, a luminance decrease rate of the display panel during the low frequency driving time.

In example embodiments, the panel driver may include a driving frequency changer comprising a high frequency insertion time storage configured to store the high frequency insertion time that is determined according to a luminance decrease rate of the display panel during the low frequency driving time, and a driving frequency changing unit configured to output output image data at the first output frame frequency when the input image data do not represent the still image, to output the output image data at the second output frame frequency for the low frequency driving time when the input image data represent the still image, and to output the output image data at the third output frame frequency for the high frequency insertion time stored in the high frequency insertion time storage after the low frequency driving time, and a data driver configured to provide data signals to the plurality of pixels based on the output image data.

In example embodiments, the high frequency insertion time may be determined according to, as the representative gray level of the input image data, an average value, a maximum value or a minimum value of gray levels of the input image data.

In example embodiments, the panel driver may include a representative gray level calculating unit configured to calculate the representative gray level of the input image data, a driving frequency changing unit configured to output output image data at the first output frame frequency when the input image data do not represent the still image, to output the output image data at the second output frame frequency for the low frequency driving time when the input image data represent the still image, and to output the output image data at the third output frame frequency for the high frequency insertion time corresponding to the representative gray level calculated by the representative gray level calculating unit after the low frequency driving time, and a data driver configured to provide data signals to the plurality of pixels based on the output image data.

In example embodiments, the driving frequency changing unit may determine the high frequency insertion time as a first time when the representative gray level is within a high gray range, may determine the high frequency insertion time as a second time shorter than the first time when the representative gray level is within a middle gray range, and may determine the high frequency insertion time as a third time longer than the first time when the representative gray level is within a low gray range.

In example embodiments, the panel driver may include a high frequency insertion time storage configured to store a plurality of high frequency insertion times respectively corresponding to a plurality of gray ranges, the plurality of high frequency insertion times being determined according to luminance decrease rates of the display panel corresponding to the plurality of gray ranges during the low frequency driving time, a representative gray level calculating unit configured to calculate the representative gray level of the input image data, a driving frequency changing unit configured to output output image data at the first output frame frequency when the input image data do not represent the still image, to output the output image data at the second output frame frequency for the low frequency driving time when the input image data represent the still image, and to output the output image data at the third output frame frequency for the high frequency insertion time selected according to the representative gray level among the plurality of high frequency insertion times stored in the high frequency insertion time storage after the low frequency driving time, and a data driver configured to provide data signals to the plurality of pixels based on the output image data.

According to example embodiments, there is provided an OLED display device including a display panel including a plurality of pixels each having an OLED, and a panel driver configured to drive the display panel. The panel driver includes a high frequency insertion pattern memory configured to store a high frequency insertion pattern that is determined according to a panel characteristic of the display panel. The panel driver receives input image data at an input frame frequency, and determines whether the input image data represent a still image. When the input image data do not represent the still image, the panel driver drives the display panel at a first output frame frequency substantially equal to the input frame frequency. When the input image data represent the still image, the panel driver drives the display panel at a second output frame frequency lower than the input frame frequency for a low frequency driving time, and drives the display panel based on the high frequency insertion pattern after the low frequency driving time.

In example embodiments, a threshold voltage shift of a plurality of driving transistors included in the plurality of pixels which occurs during the low frequency driving time may be compensated while the display panel is driven based on the high frequency insertion pattern.

In example embodiments, the high frequency insertion pattern stored in the high frequency insertion pattern memory may represent at least one third output frame frequency higher than the second output frame frequency, and a number of frames for the third output frame frequency. After the low frequency driving time, the panel driver may drive the display panel at the third output frame frequency for a time corresponding to the number of frames based on the high frequency insertion pattern.

In example embodiments, the third output frame frequency may be lower than or equal to the first output frame frequency.

In example embodiments, the high frequency insertion pattern memory may store a plurality of high frequency insertion patterns that are different from each other, and the high frequency insertion pattern may be one of the plurality of high frequency insertion patterns. The high frequency insertion pattern memory may further store pattern select information indicating a selected one of the plurality of high frequency insertion patterns. After the low frequency driving time, the panel driver may drive the display panel based on the selected one of the plurality of high frequency insertion patterns.

In example embodiments, the high frequency insertion pattern memory may store a plurality of high frequency insertion patterns respectively corresponding to a plurality of gray ranges, the high frequency insertion pattern may be one of the plurality of high frequency insertion patterns, and the plurality of high frequency insertion patterns may be determined according to luminance decrease rates of the display panel corresponding to the plurality of gray ranges during the low frequency driving time.

In example embodiments, the panel driver may further include a representative gray level calculating unit configured to calculate the representative gray level of the input image data, a driving frequency changing unit configured to output output image data at the first output frame frequency when the input image data do not represent the still image, to output the output image data at the second output frame frequency for the low frequency driving time when the input image data represent the still image, and to output the output image data based on the high frequency insertion pattern selected according to the representative gray level among the plurality of high frequency insertion patterns stored in the high frequency insertion pattern memory after the low frequency driving time, and a data driver configured to provide data signals to the plurality of pixels based on the output image data.

As described above, an OLED display device according to example embodiments may determine whether input image data represent a still image. When the input image data represent the still image, the OLED display device may drive a display panel at an output frame frequency lower than an input frame frequency for a low frequency driving time, and may drive the display panel at a frequency higher than the output frame frequency for a high frequency insertion time after the low frequency driving time. Accordingly, a threshold voltage shift of a plurality of driving transistors which occurs during the low frequency driving time may be compensated during the high frequency insertion time, thereby reducing or preventing luminance deterioration and a flicker. Further, the high frequency insertion time may be determined based on at least one of a panel characteristic of the display panel and a representative gray level of the input image data, and thus high frequency insertion suitable for each display panel may be performed.

Further, an OLED display device according to other example embodiments may determine whether input image data represent a still image. When the input image data represent the still image, the OLED display device may drive a display panel at an output frame frequency lower than an input frame frequency for a low frequency driving time, and may drive the display panel based on a high frequency insertion pattern that is determined according to a panel characteristic of the display panel after the low frequency driving time. Accordingly, the luminance deterioration and the flicker caused by the low frequency driving may be reduced or prevented, and the high frequency insertion suitable for each display panel may be performed.

BRIEF DESCRIPTION OF THE DRAWINGS

Illustrative, non-limiting example embodiments will be more clearly understood from the following detailed description in conjunction with the accompanying drawings.

FIG. 15 is a diagram illustrating an example of a high frequency insertion pattern stored in a high frequency insertion pattern memory included in an OLED display device according to example embodiments;

FIG. 19 is a diagram illustrating an example of a plurality of high frequency insertion patterns respectively corresponding to a plurality of gray ranges.

DETAILED DESCRIPTION OF THE EMBODIMENTS

Hereinafter, embodiments of the present inventive concept will be explained in detail with reference to the accompanying drawings.

Figure 1:
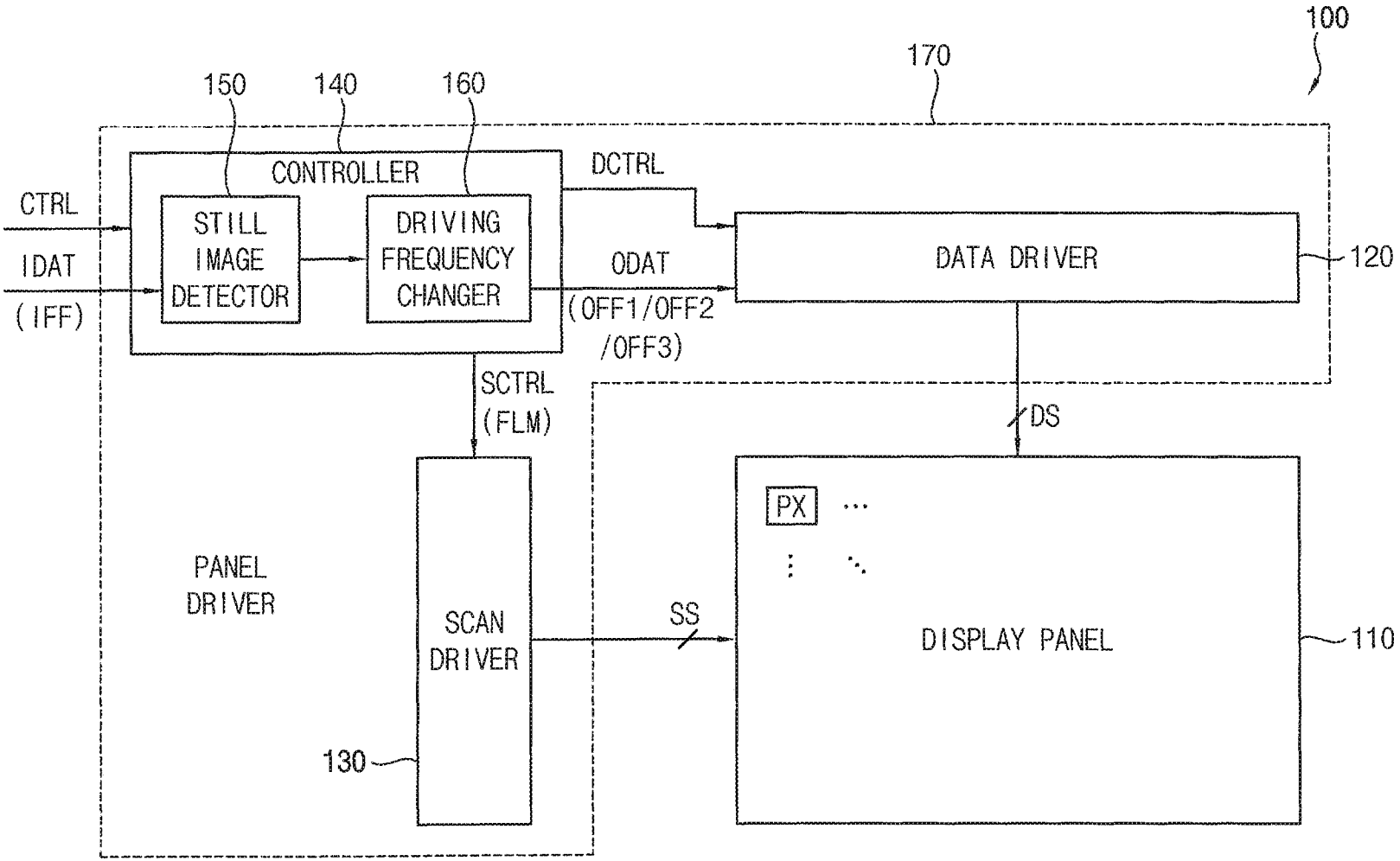
FIG. 1 is a block diagram illustrating an organic light emitting diode (OLED) display device according to example embodiments.
Figure 2:
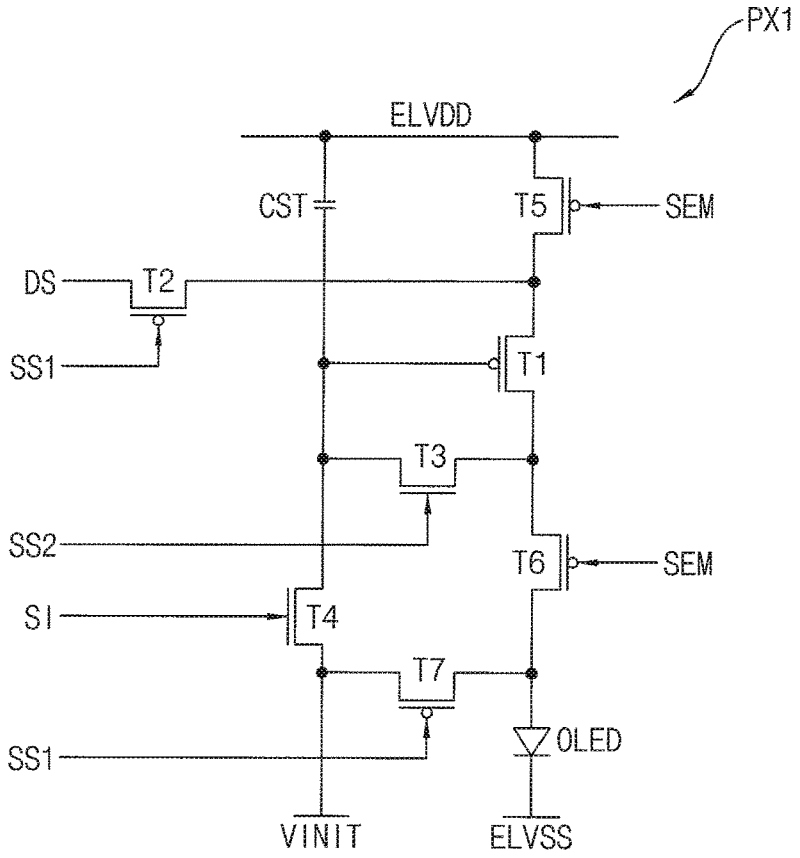
FIG. 2 is a circuit diagram illustrating an example of a pixel included in an OLED display device according to example embodiments.
Figure 3:
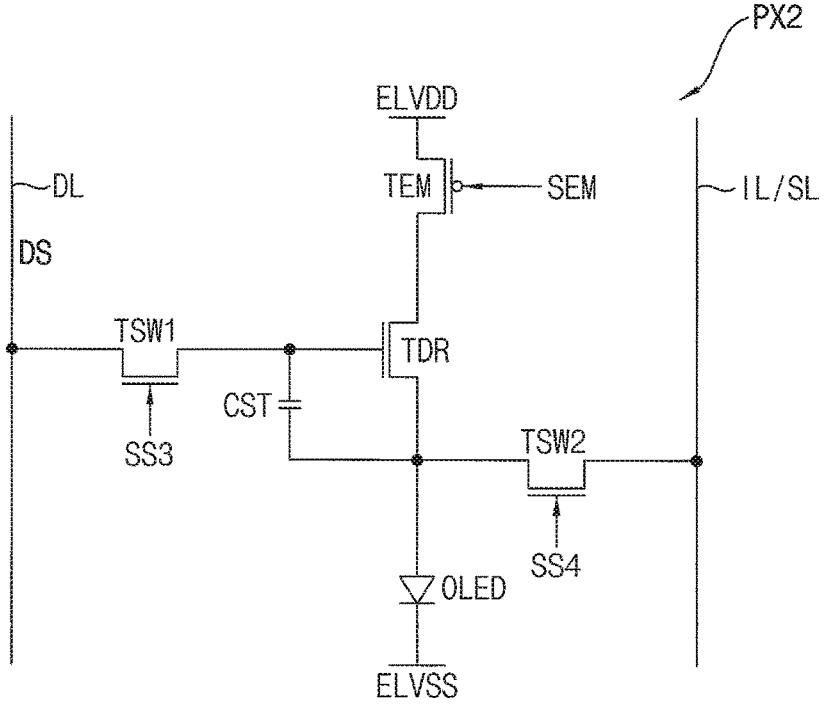
FIG. 3 is a circuit diagram illustrating another example of a pixel included in an OLED display device according to example embodiments.
Figure 4:
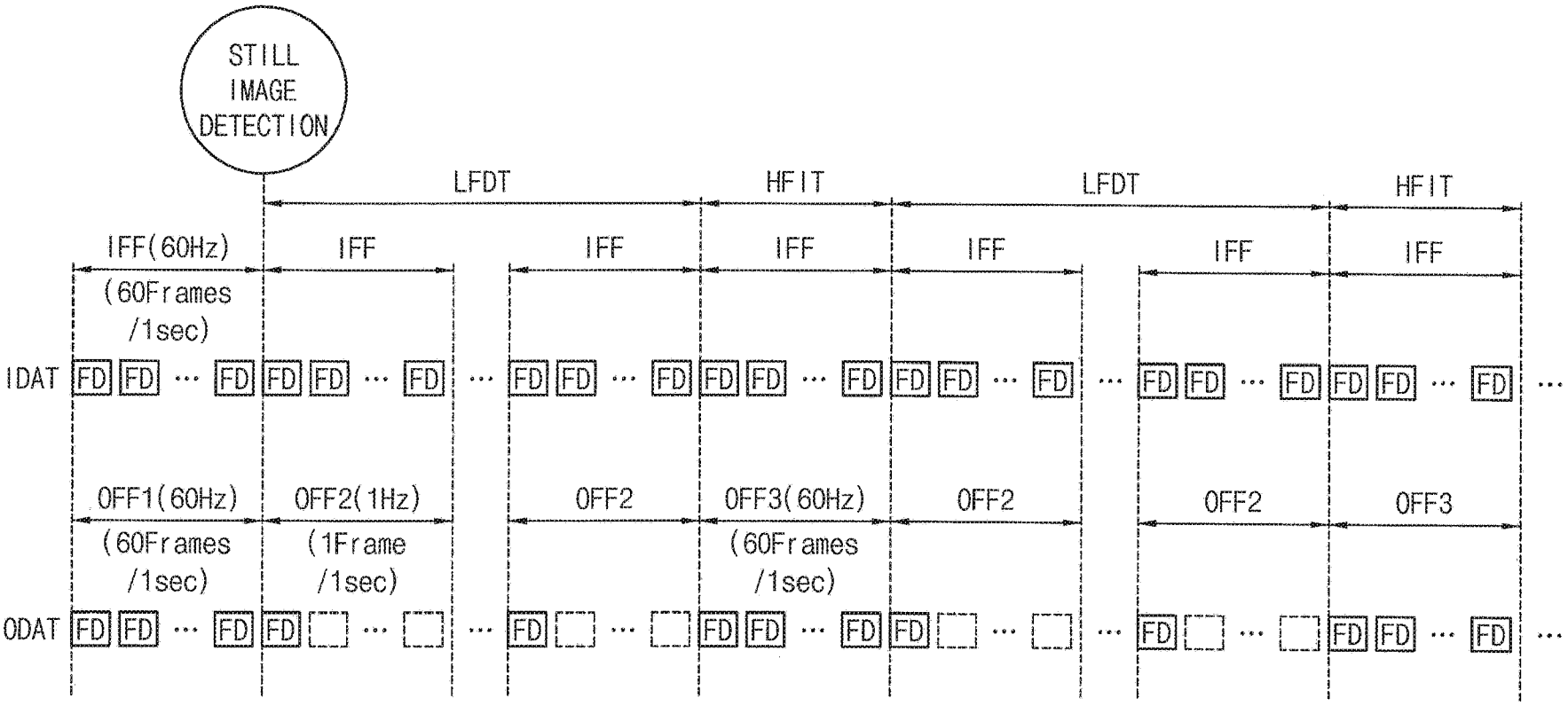
FIG. 4 is a timing diagram for describing an example of an operation of an OLED display device according to example embodiments.
Figure 5:
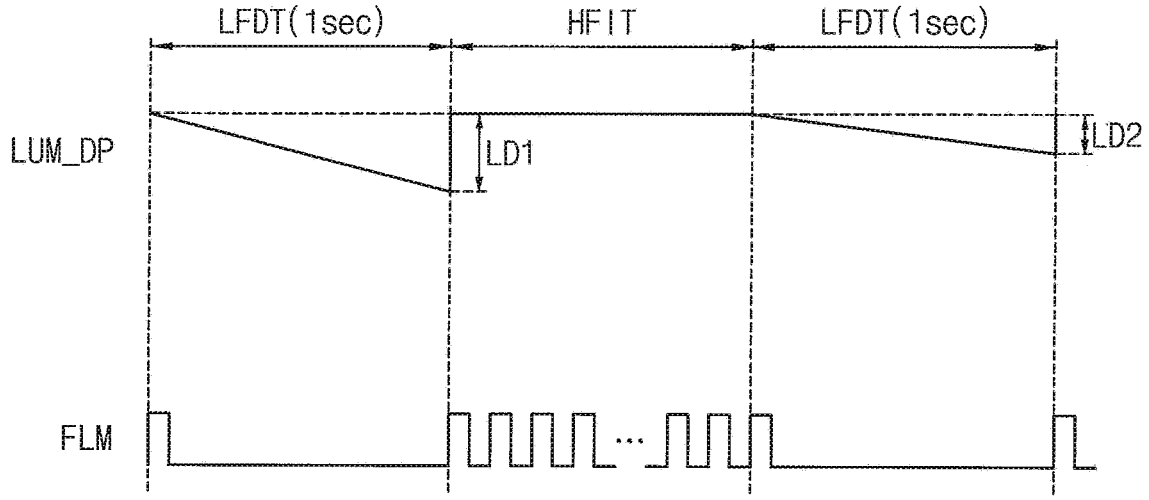
FIG. 5 is a diagram illustrating an example of luminance of a display panel in a case where a high frequency insertion time is inserted while low frequency driving is performed.

FIG. 1 is a block diagram illustrating an organic light emitting diode (OLED) display device according to example embodiments, FIG. 2 is a circuit diagram illustrating an example of a pixel included in an OLED display device according to example embodiments, FIG. 3 is a circuit diagram illustrating another example of a pixel included in an OLED display device according to example embodiments, FIG. 4 is a timing diagram for describing an example of an operation of an OLED display device according to example embodiments, and FIG. 5 is a diagram illustrating an example of luminance of a display panel in a case where a high frequency insertion time is inserted while low frequency driving is performed.

Referring to FIG. 1, an OLED display device 100 according to example embodiments may include a display panel 110 that includes a plurality of pixels PX, and a panel driver 170 that drives the display panel 110. In some example embodiments, the panel driver 170 may include a data driver 120 that provides data signals DS to the plurality of pixels PX, a scan driver 130 that provides scan signals SS to the plurality of pixels PX, and a controller 140 that controls the data driver 120 and the scan driver 130.

The display panel 110 may include a plurality of data lines, a plurality of scan lines, and the plurality of pixels PX coupled to the plurality of data lines and the plurality of scan lines. In some example embodiments, each pixel PX may include at least one capacitor, at least two transistors and an organic light emitting diode (OLED), and the display panel 110 may be an OLED display panel. In some example embodiments, each pixel PX may be a hybrid oxide polycrystalline (HOP) pixel suitable for low frequency driving for reducing power consumption. For example, in the HOP pixel, at least one first transistor may be a low-temperature polycrystalline silicon (LTPS) P-type Metal Oxide Semiconductor (PMOS) transistor, and at least one second transistor may be an oxide N-type Metal Oxide Semiconductor (NMOS) transistor.

In some example embodiments, as illustrated in FIG. 2, each pixel PX may be a HOP pixel PX1 where a driving transistor T1 is implemented with a PMOS transistor. For example, each pixel PX1 may include the driving transistor T1 that generates a driving current, a switching transistor T2 that transfers a data signal DS to a source of the driving transistor T1 in response to a first scan signal SS1, a compensating transistor T3 that diode-connects the driving transistor T1 in response to a second scan signal SS2, a storage capacitor CST that stores the data signal DS transferred through the switching transistor T2 and the diode-connected driving transistor T1, a first initializing transistor T4 that provides an initialization voltage VINIT to the storage capacitor CST and a gate of the driving transistor T1 in response to an initialization signal SI, a first emission controlling transistor T5 that connects a line of a high power supply voltage ELVDD to the source of the driving transistor T1 in response to an emission control signal SEM, a second emission controlling transistor T6 that connect a drain of the driving transistor T1 to the OLED in response to the emission control signal SEM, a second initializing transistor T7 that provides the initialization voltage VINIT to the OLED in response to the first scan signal SS1, and the OLED that emits light based on the driving current flowing from the line of the high power supply voltage ELVDD to a line of a low power supply voltage ELVSS.

In some example embodiments, at least one of the driving transistor T1, the switching transistor T2, the compensating transistor T3, the first initializing transistor T4, the first emission controlling transistor T5, the second emission controlling transistor T6 and the second initializing transistor T7 may be implemented with a PMOS transistor, and at least one of the driving transistor T1, the switching transistor T2, the compensating transistor T3, the first initializing transistor T4, the first emission controlling transistor T5, the second emission controlling transistor T6 and the second initializing transistor T7 may be implemented with an NMOS transistor. For example, as illustrated in FIG. 2, the compensating transistor T3 and the first initializing transistor T4 of which drains or sources are directly connected to the storage capacitor CST may be implemented with NMOS transistors, and other transistors T1, T2, T5, T6 and T7 may be implemented with PMOS transistors. In this case, the second scan signal SS2 applied to the compensating transistor T3 and the initialization signal SI applied to the first initializing transistor T4 may be active high signals that are suitable for the NMOS transistors. Furthermore, the second scan signal SS2 may be an inversion signal of the first scan signal SS1. Since the transistors T3 and T4 directly connected to the storage capacitor CST are implemented with the NMOS transistors, a leakage current from the storage capacitor CST may be reduced, and thus each pixel PX1 may be suitable for the low frequency driving. Although FIG. 2 illustrates an example where the compensating transistor T3 and the first initializing transistor T4 are implemented with the NMOS transistors, a configuration of each pixel PX1 according to example embodiments may not be limited to an example of FIG. 2. For example, in each pixel PX1, the switching transistor T2 also may be implemented with the NMOS transistor.

In other example embodiments, as illustrated in FIG. 3, each pixel PX may be a HOP pixel PX2 where a driving transistor TDR is implemented with an NMOS transistor. For example, each pixel PX2 may include a driving transistor TDR that generates a driving current, a first switching transistor TSW1 that transfers a data signal DS from a data line DL to a storage capacitor CST in response to a third scan signal SS3, the storage capacitor CST that stores the data signal DS transferred through the first switching transistor TSW1, a second switching transistor TSW2 that connects the storage capacitor CST and the driving transistor TDR to an initialization line IL (or a sensing line SL) in response to a fourth scan signal SS4, an emission controlling transistor TEM that connects a line of a high power supply voltage ELVDD to the driving transistor TDR in response to an emission control signal SEM, and the OLED that emits light based on the driving current flowing from the line of the high power supply voltage ELVDD to a line of a low power supply voltage ELVSS.

In some example embodiments, at least one of the driving transistor TDR, the first switching transistor TSW1, the second switching transistor TSW2 and the emission controlling transistor TEM may be implemented with a PMOS transistor, and at least one of the driving transistor TDR, the first switching transistor TSW1, the second switching transistor TSW2 and the emission controlling transistor TEM may be implemented with an NMOS transistor. For example, as illustrated in FIG. 3, the driving transistor TDR, the first switching transistor TSW1 and the second switching transistor TSW2 may be implemented with NMOS transistors, and the emission controlling transistor TEM may be implemented with a PMOS transistor.

Although FIGS. 2 and 3 illustrate examples of the pixels PX1 and PX2, each pixel PX included in the OLED display device 100 according to example embodiments may not be limited to examples of FIGS. 2 and 3.

Referring back to FIG. 1, the data driver 120 may generate the data signals DS based on output image data ODAT and a data control signal DCTRL received from the controller 140, and may provide the data signals DS to the plurality of pixels PX through the plurality of data lines. In a case where a still image is not displayed, or in a case where a moving image is displayed, the data driver 120 may receive the output image data ODAT at a first output frame frequency OFF1 substantially the same as an input frame frequency IFF of input image data IDAT from the controller 140, and may drive the display panel 110 at the first output frame frequency OFF1 based on the output image data ODAT. Further, in a case where the still image is displayed, the data driver 120 may receive the output image data ODAT at a second output frame frequency OFF2 lower than the input frame frequency IFF from the controller 140 for a low frequency driving time, and may drive the display panel 110 at the second output frame frequency OFF2 based on the output image data ODAT for the low frequency driving time. After the low frequency driving time, the data driver 120 may receive the output image data ODAT at a third output frame frequency OFF3 higher than the second output frame frequency OFF2 and lower than or equal to the input frame frequency IFF from the controller 140 for a high frequency insertion time, and may drive the display panel 110 at the third output frame frequency OFF3 based on the output image data ODAT for the high frequency insertion time. In some example embodiments, the data control signal DCTRL may include, but not be limited to, an output data enable signal, a horizontal start signal and a load signal. In some example embodiments, the data driver 120 and the controller 140 may be implemented with a single integrated circuit, and the single integrated circuit may be referred to as a timing controller embedded data driver (TED). In other example embodiments, the data driver 120 and the controller 140 may be implemented with separate integrated circuits.

Still referring to FIG. 1, the scan driver 130 may provide the scan signals SS to the plurality of pixels PX through the plurality of scan lines based on a scan control signal SCTRL received from the controller 140. In some example embodiments, the scan driver 130 may sequentially provide the scan signals SS to the plurality of pixels PX on a row-by-row basis. Further, in some example embodiments, the scan control signal SCTRL may include, but not be limited to, a scan start signal FLM and a scan clock signal. The scan driver 130 may initiate a scan operation that provides the scan signals SS to the plurality of pixels PX in response to the scan start signal FLM. In some example embodiments, the scan driver 130 may be integrated or formed in a peripheral portion of the display panel 110. In other example embodiments, the scan driver 130 may be implemented in the form of an integrated circuit.

The controller (e.g., a timing controller; TCON) 140 may receive input image data IDAT and a control signal CTRL from an external host processor (e.g., an application processor (AP), a graphic processing unit (GPU) or a graphic card)). In some example embodiments, the input image data IDAT may be an RGB image data including red image data, green image data and blue image data. Further, in some example embodiments, the control signal CTRL may include, but not be limited to, a vertical synchronization signal, a horizontal synchronization signal, an input data enable signal, a master clock signal, etc. The controller 140 may generate the output image data ODAT, the data control signal DCTRL, and the scan control signal SCTRL based on the input image data IDAT and the control signal CTRL. The controller 140 may control an operation of the data driver 120 by providing the output image data ODAT and the data control signal DCTRL to the data driver 120, and may control an operation of the scan driver 130 by providing the scan control signal SCTRL to the scan driver 130.

The controller 140 may receive the input image data IDAT at the input frame frequency IFF from the host processor, and may determine whether the input image data IDAT represent a still image. In some example embodiments, the input frame frequency IFF may be a constant or fixed frequency. For example, the input frame frequency IFF may be, but not be limited to, about 60 Hz, about 120 Hz, or the like. In a case where the input image data IDAT do not represent the still image, or in a case where the input image data IDAT represent the moving image, the controller 140 may control the data driver 120 and the scan driver 130 to drive the display panel 110 at the first output frame frequency OFF1 substantially the same as the input frame frequency IFF. In a case where the input image data IDAT represent the still image, the controller 140 may control the data driver 120 and the scan driver 130 to drive the display panel 110 at the second output frame frequency OFF2 lower than the input frame frequency IFF for the low frequency driving time. After the low frequency driving time, the controller 140 may control the data driver 120 and the scan driver 130 to drive the display panel 110 at the third output frame frequency OFF3 higher than the second output frame frequency OFF2 and lower than or equal to the input frame frequency IFF for the high frequency insertion time. In some example embodiments, the high frequency insertion time may be determined based on at least one of a panel characteristic of the display panel 110 and a representative gray level of the input image data IDAT. After the high frequency insertion time, the controller 140 may control the data driver 120 and the scan driver 130 to drive the display panel 110 again at the second output frame frequency OFF2. To perform these operations, the controller 140 may include a still image detector 150 and a driving frequency changer 160.

The still image detector 150 may determine whether the input image data IDAT represent the still image. For example, the still image detector 150 may compare the input image data IDAT in a previous frame and the input image data IDAT in a current frame, may determine that the input image data IDAT do not represent the still image when the input image data IDAT in the current frame are different from the input image data IDAT in the previous frame, and may determine that the input image data IDAT represent the still image when the input image data IDAT in the current frame are substantially the same as the input image data IDAT in the previous frame. In some example embodiments, to compare the input image data IDAT in the previous frame and the input image data IDAT in the current frame, the still image detector 150 may calculate a representative value (e.g., an average value, a checksum, etc.) of the input image data IDAT in the previous frame and a representative value of and the input image data IDAT in the current frame, and may compare the representative values.

The driving frequency changer 160 may selectively output the input image data IDAT as the output image data ODAT according to whether the input image data IDAT represent the still image. In a case where the input image data IDAT do not represent the still image, the driving frequency changer 160 may output all the input image data IDAT as the output image data ODAT. For example, as illustrated in FIG. 4, in a case where the input image data IDAT are received at the input frame frequency IFF of about 60 Hz (or where frame data FD of sixty frames per one second are received as the input image data IDAT), and the input image data IDAT do not represent the still image, the driving frequency changer 160 may output the frame data FD of the sixty frames as the output image data ODAT for one second such that the output image data ODAT are output at the first output frame frequency OFF1 of about 60 Hz substantially the same as the input frame frequency IFF. The data driver 120 may receive the frame data FD of the sixty frames as the output image data ODAT for one second, and may drive the display panel 110 at the first output frame frequency OFF1 of about 60 Hz based on the frame data FD of the sixty frames for one second. In some example embodiments, the controller 140 may perform predetermined data processing on the output image data ODAT generated from the driving frequency changer 160, and the output image data ODAT on which the data processing is performed may be provided to the data driver 120. For example, the data processing performed by the controller 140 may include, but not be limited to, pentile data conversion that converts the RGB image data into image data suitable for a pentile pixel arrangement, luminance compensation, color correction, etc. Furthermore, the controller 140 may provide the scan start signal FLM at the first output frame frequency OFF1 of about 60 Hz to the scan driver 130, and the scan driver 130 may perform the scan operation sixty times for one second in response to the scan start signal FLM.

In a case where the input image data IDAT represent the still image, the driving frequency changer 160 may output, among the input image data IDAT of a plurality of frames, the input image data IDAT of a first portion of the plurality of frames as the output image data ODAT for the low frequency driving time LFDT. For example, as illustrated in FIG. 4, in a case where the input image data IDAT are received at the input frame frequency IFF of about 60 Hz (or where the frame data FD of the sixty frames per one second are received as the input image data IDAT), and the input image data IDAT represent the still image, the driving frequency changer 160 may output, as the output image data ODAT, the frame data FD of one frame among the frame data FD of the sixty frames for one second such that the output image data ODAT are output at the second output frame frequency OFF2 of about 1 Hz lower than the input frame frequency IFF. Although FIG. 4 illustrates an example where the second output frame frequency OFF2 is about 1 Hz, the second output frame frequency OFF2 may be any frequency lower than the input frame frequency IFF. The data driver 120 may receive the frame data FD of the one frame as the output image data ODAT for one second, and may drive the display panel 110 at the second output frame frequency OFF2 of about 1 Hz based on the frame data FD of the one frame for one second. Furthermore, the controller 140 may provide the scan start signal FLM at the second output frame frequency OFF2 of about 1 Hz to the scan driver 130, and the scan driver 130 may perform the scan operation once for one second in response to the scan start signal FLM.

After the low frequency driving time LFDT, the driving frequency changer 160 may output, among the input image data IDAT of the plurality of frames, the input image data IDAT of a second portion greater than the first portion of the plurality of frames or the input image data IDAT of all of the plurality of frames as the output image data ODAT for the high frequency insertion time HFIT. According to example embodiments, the low frequency driving time LFDT may be determined according to the panel characteristic of the display panel 110, or may be settable. For example, as illustrated in FIG. 4, in a case where the input image data IDAT are received at the input frame frequency IFF of about 60 Hz (or where the frame data FD of the sixty frames per one second are received as the input image data IDAT), and the input image data IDAT represent the still image, the driving frequency changer 160 may output, as the output image data ODAT, the frame data FD of the sixty frames among the frame data FD of the sixty frames for one second such that the output image data ODAT are output at the third output frame frequency OFF3 of about 60 Hz higher than the second output frame frequency OFF2. Although FIG. 4 illustrates an example where the third output frame frequency OFF3 is the same as the first output frame frequency OFF1 of about 60 Hz, or the input frame frequency IFF of about 60 Hz, the third output frame frequency OFF3 may be any frequency higher than the second output frame frequency OFF2 and lower than or equal to the first output frame frequency OFF1 (i.e., the input frame frequency IFF). The data driver 120 may receive the frame data FD of the sixty frames as the output image data ODAT for one second, and may drive the display panel 110 at the third output frame frequency OFF3 of about 60 Hz based on the frame data FD of the sixty frames for one second. Furthermore, the controller 140 may provide the scan start signal FLM at the third output frame frequency OFF3 of about 60 Hz to the scan driver 130, and the scan driver 130 may perform the scan operation sixty times for one second in response to the scan start signal FLM.

After the high frequency insertion time HFIT, the driving frequency changer 160 may output the output image data ODAT again at the second output frame frequency OFF2, and the data driver 120 may drive the display panel 110 again at the second output frame frequency OFF2 based on the output image data ODAT. In some example embodiments, if the low frequency driving at the second output frame frequency OFF2 is performed again for the low frequency driving time LFDT, the display panel 110 may be driven again at the third output frame frequency OFFS for the high frequency insertion time HFIT. That is, in some example embodiments, the high frequency insertion time HFIT may be periodically inserted while the still image represented by the input image data IDAT is not changed. For example, as illustrated in FIG. 4, while the still image represented by the input image data IDAT is not changed, the high frequency insertion time HFIT may be periodically appended to the low frequency driving time LFDT.

In some example embodiments, a threshold voltage shift of a plurality of driving transistors included in the plurality of pixels PX which occurs during the low frequency driving time LFDT may be compensated during the high frequency insertion time HFIT. For example, during the low frequency driving time LFDT, an off-bias may be applied to the plurality of driving transistors, and thus threshold voltages of the plurality of driving transistors may be shifted, which results in a deterioration of luminance of the display panel 110. For example, as illustrated in FIG. 5, in the low frequency driving time LFDT before the high frequency insertion time HFIT, the luminance LUM_DP of the display panel 110 may decrease from a time point when the data signals DS are stored in the display panel 110 in response to the scan start signal FLM, and the decrease of the luminance LUM_DP of the display panel 110 may be intensified by the threshold voltage shift. Furthermore, because of the decrease of the luminance LUM_DP of the display panel 110, a flicker may occur based on a luminance difference LD1 of the luminance LUM_DP of the display panel 110 at a time point when the data signals DS are again stored in the display panel 110 in response to the next scan start signal FLM. However, in the OLED display device 100 according to example embodiments, an on-bias may be applied to the plurality of driving transistors during the high frequency insertion time HFIT after the low frequency driving time LFDT, and thus the threshold voltage shift may be compensated during the high frequency insertion time HFIT. Accordingly, in the low frequency driving time LFDT after the high frequency insertion time HFIT, a decrease rate of the luminance LUM_DP of the display panel 110 may be reduced, and thus the luminance deterioration caused by the low frequency driving may be reduced or prevented. Still furthermore, since the decrease rate of the luminance LUM_DP of the display panel 110 is reduced, the luminance difference LD2 of the luminance LUM_DP of the display panel 110 at a time point when the data signals DS are again stored in the display panel 110 in response to the next scan start signal FLM may be reduced, and thus the occurrence of the flicker may be reduced or prevented.

However, if the high frequency insertion time HFIT inserted during the low frequency driving is excessively long, the power consumption may not be reduced during the low frequency driving. Furthermore, if the high frequency insertion time HFIT is excessively short, the threshold voltage shift may not be sufficiently compensated, and the luminance deterioration and the flicker may not be reduced or prevented. Still furthermore, the threshold voltage shift and the luminance deterioration may occur at different levels with respect to different display panels 110. However, in the OLED display device 100 according to example embodiments, the high frequency insertion time HFIT may be determined based on at least one of the panel characteristic of the display panel 110 (e.g., the luminance decrease rate of the display panel 110 during the low frequency driving time LFDT) and the representative gray level of the input image data IDAT. Thus, the display panel 110 may be driven at the third output frame frequency OFF3 higher than the second output frame frequency OFF2 for the high frequency insertion time HFIT suitable for each display panel 110. That is, the high frequency insertion may be performed corresponding to each display panel 110. Accordingly, in the OLED display device 100 according to example embodiments, the reduction of the power consumption may be maximized by the low frequency driving, the threshold voltage shift may be sufficiently compensated, and the luminance deterioration and the flicker caused by the low frequency driving may be reduced or prevented.

Figure 6:
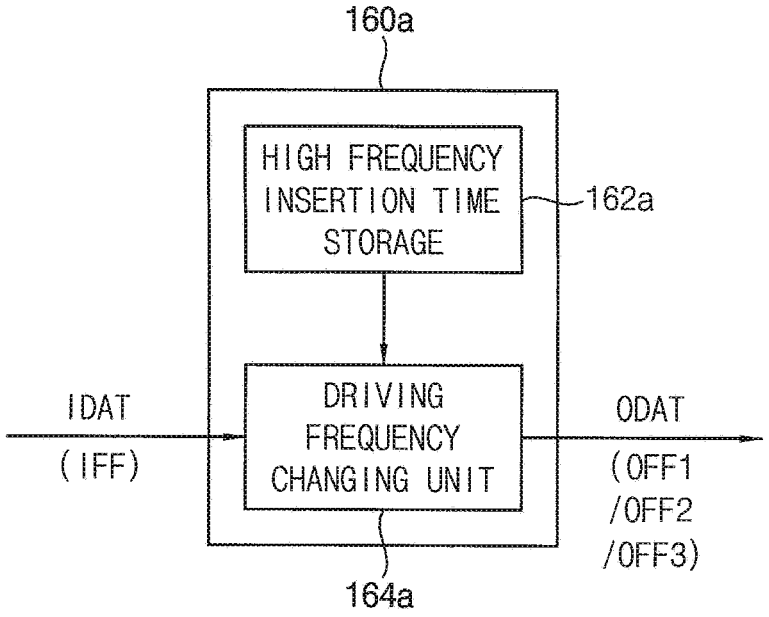
FIG. 6 is a block diagram illustrating a driving frequency changer included in an OLED display device according to example embodiments.
Figure 7:
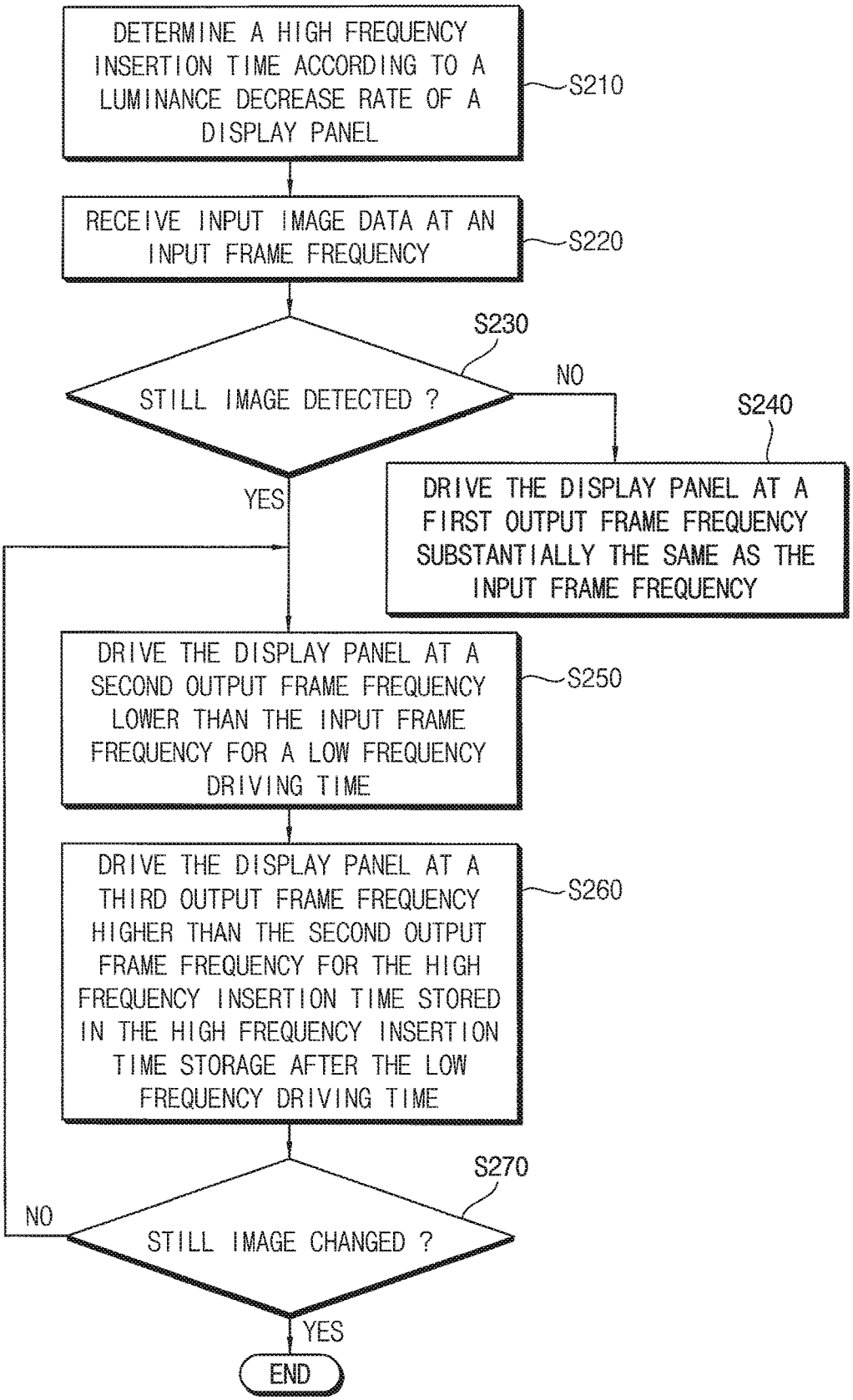
FIG. 7 is a flowchart illustrating a method of operating an OLED display device according to example embodiments.
Figure 8:
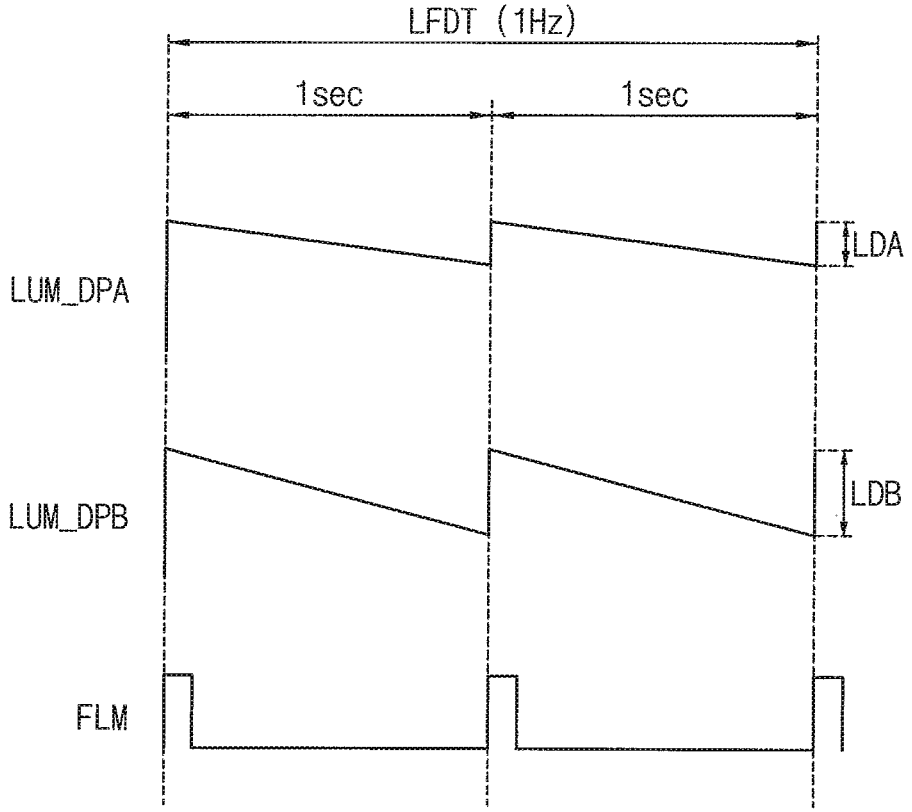
FIG. 8 is a diagram illustrating examples of luminance of different display panels while low frequency driving is performed.

FIG. 6 is a block diagram illustrating a driving frequency changer included in an OLED display device according to example embodiments, FIG. 7 is a flowchart illustrating a method of operating an OLED display device according to example embodiments, and FIG. 8 is a diagram illustrating examples of luminance of different display panels while low frequency driving is performed.

Referring to FIGS. 1 and 6, a driving frequency changer 160*a* included in an OLED display device 100 according to example embodiments may include a high frequency insertion time storage 162*a* that stores a high frequency insertion time suitable for a display panel 110, and a driving frequency changing unit 164*a* that receives input image data IDAT at an input frame frequency IFF, and outputs output image data ODAT at a first output frame frequency OFF1, a second output frame frequency OFF2 or a third output frame frequency OFF3.

The high frequency insertion time storage 162*a* may store the high frequency insertion time that is determined according to a panel characteristic of the display panel 110. In some example embodiments, the high frequency insertion time stored in the high frequency insertion time storage 162*a* may be determined according to a luminance decrease rate of the display panel 110 as the panel characteristic of the display panel 110 during a low frequency driving time. For example, the high frequency insertion time may be determined to be relatively long with respect to the display panel 110 having a relatively high luminance decrease rate, and may be determined to be relatively short with respect to the display panel 110 having a relatively low luminance decrease rate.

The driving frequency changing unit 164*a* may output the output image data ODAT at the first output frame frequency OFF1 substantially the same as the input frame frequency IFF when the input image data IDAT do not represent the still image, and may output the output image data ODAT at the second output frame frequency OFF2 lower than the input frame frequency IFF for the low frequency driving time when the input image data represent the still image. Furthermore, after the low frequency driving time, the driving frequency changing unit 164*a* may output the output image data ODAT at the third output frame frequency OFF3 higher than the second output frame frequency OFF2 for the high frequency insertion time stored in the high frequency insertion time storage 162*a*.

Hereinafter, a method of operating the OLED display device 100 including the driving frequency changer 160*a* will be described below with reference to FIGS. 1, 6, 7 and 8.

Referring to FIGS. 1, 6 and 7, the high frequency insertion time may be determined according to the luminance decrease rate of the display panel 110 during the low frequency driving time, and the determined high frequency insertion time may be stored in the high frequency insertion time storage 162*a* may be as the panel characteristic of the display panel 110 (S210). That is, different display panels may have different luminance decrease rates, and the high frequency insertion times suitable for the respective display panels may be determined. FIG. 8 illustrates examples of luminance LUM_DPA of a first display panel and luminance LUM_DPB of a second display panel during the low frequency driving time LFDT. For example, as illustrated in FIG. 8, in a case where a decrease rate of the luminance LUM_DPB of the second display panel is greater than a decrease rate of the luminance LUM_DPA of the first display panel, or in a case where a luminance difference LDB of the luminance LUM_DPB of the second display panel at a time portion when a scan start signal FLM is applied is greater than a luminance difference LDA of the luminance LUM_DPA of the first display panel at the time portion when the scan start signal FLM is applied, the high frequency insertion time for the second display panel may be determined to be longer than the high frequency insertion time for the first display panel.

A panel driver 170 may receive the input image data IDAT at the input frame frequency IFF from a host processor (S220), and may determine whether the input image data IDAT represent the still image (S230). For example, a still image detector 150 included in the panel driver 170 may determine whether the input image data IDAT represent the still image by comparing the input image data IDAT in a previous frame and the input image data IDAT in a current frame.

When the input image data IDAT do not represent the still image (S230: NO), the panel driver 170 may drive the display panel 110 at the first output frame frequency OFF1 substantially the same as the input frame frequency IFF (S240). For example, the driving frequency changing unit 164*a* may output the output image data ODAT at the first output frame frequency OFF1 substantially the same as the input frame frequency IFF, and a data driver 120 may drive the display panel 110 at the first output frame frequency OFF1 based on the output image data ODAT.

When the input image data IDAT represent the still image (S230: YES), the panel driver 170 may drive the display panel 110 at the second output frame frequency OFF2 lower than the input frame frequency IFF for the low frequency driving time (S250), and may drive the display panel 110 at the third output frame frequency OFF3 higher than the second output frame frequency OFF2 and lower than or equal to the first output frame frequency OFF1 for the high frequency insertion time stored in the high frequency insertion time storage 162*a* after the low frequency driving time (S260). For example, during the low frequency driving time, the driving frequency changing unit 164*a* may output the output image data ODAT at the second output frame frequency OFF2, and the data driver 120 may drive the display panel 110 at the second output frame frequency OFF2 based on the output image data ODAT. Furthermore, during the high frequency insertion time after the low frequency driving time, the driving frequency changing unit 164*a* may output the output image data ODAT at the third output frame frequency OFF3, and the data driver 120 may drive the display panel 110 at the third output frame frequency OFF3 based on the output image data ODAT. In some example embodiments, driving the display panel 110 at the second output frame frequency OFF2 for the low frequency driving time and driving the display panel 110 at the third output frame frequency OFF3 for the high frequency insertion time may be repeated until the still image represented by the input image data IDAT are changed (S270).

As described above, in the method of operating the OLED display device 100 according to example embodiments, the high frequency insertion time may be determined according to the panel characteristic of the display panel 110, or according to the luminance decrease rate of the display panel 110 during the low frequency driving time LFDT. Accordingly, power consumption may be reduced by low frequency driving, a threshold voltage shift may be sufficiently compensated, and luminance deterioration and a flicker caused by the low frequency driving may be reduced or prevented.

Figure 9:
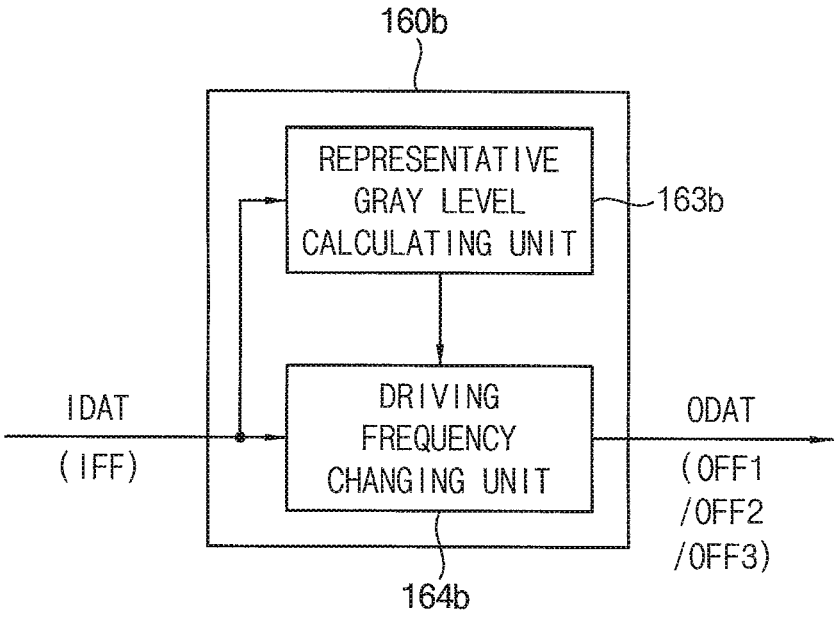
FIG. 9 is a block diagram illustrating a driving frequency changer included in an OLED display device according to example embodiments.
Figure 10:
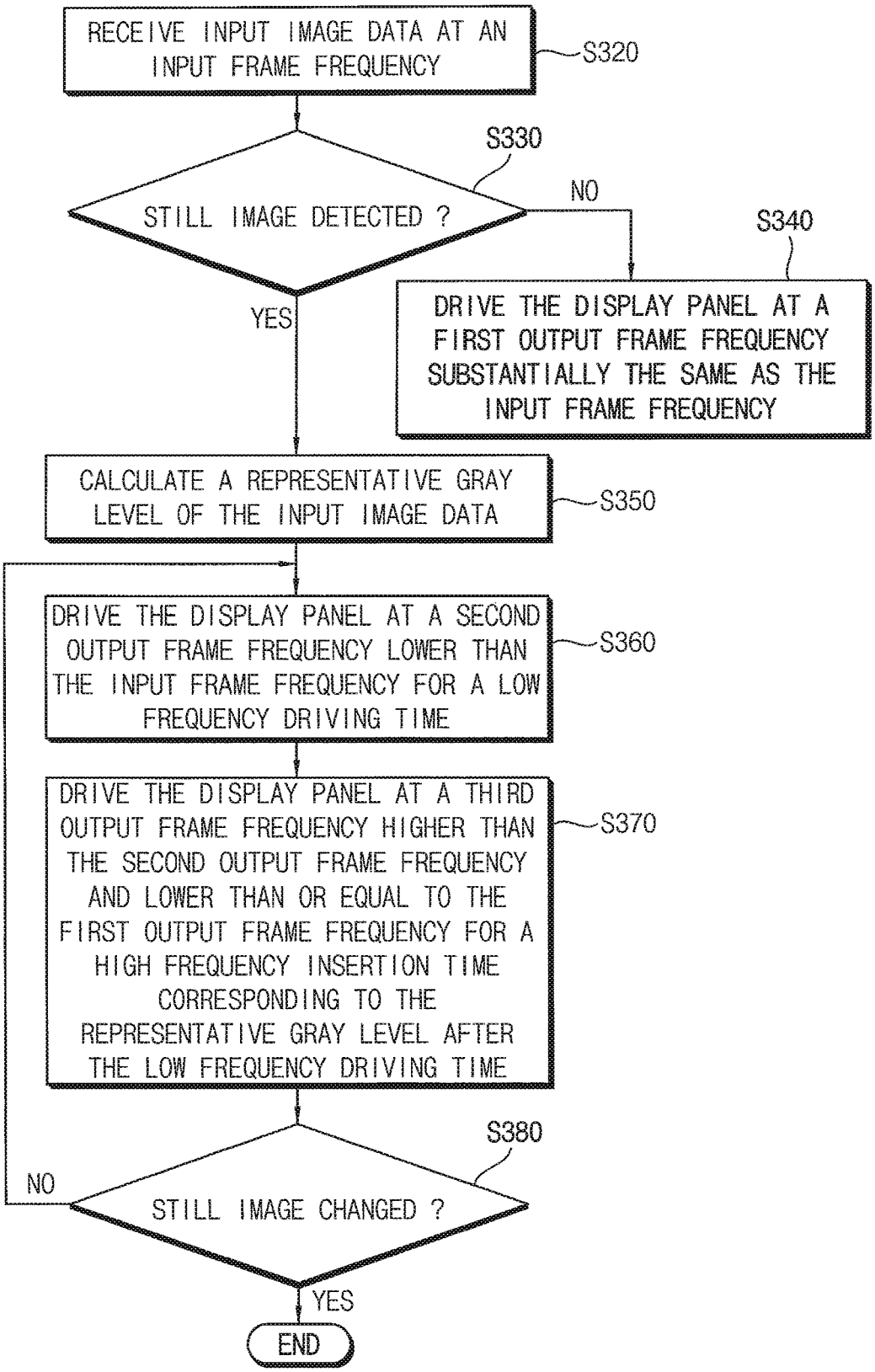
FIG. 10 is a flowchart illustrating a method of operating an OLED display device according to example embodiments.
Figures 11, 12:
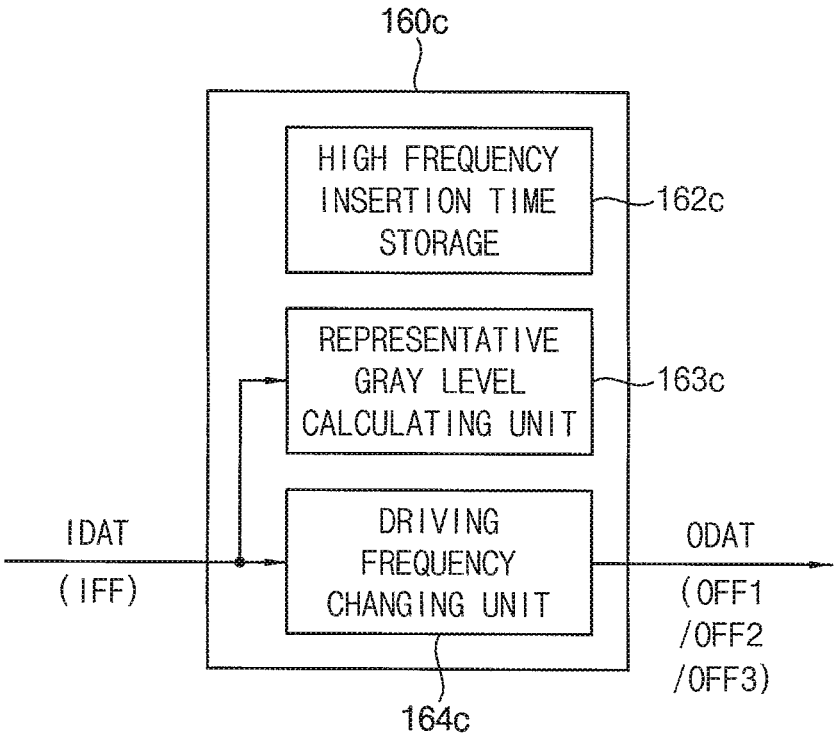
FIG. 11 is a diagram illustrating an example of a plurality of high frequency insertion times respectively corresponding to a plurality of gray ranges.
FIG. 12 is a block diagram illustrating a driving frequency changer included in an OLED display device according to example embodiments.

FIG. 9 is a block diagram illustrating a driving frequency changer included in an OLED display device according to example embodiments, FIG. 10 is a flowchart illustrating a method of operating an OLED display device according to example embodiments, and FIG. 11 is a diagram illustrating an example of a plurality of high frequency insertion times respectively corresponding to a plurality of gray ranges.

Referring to FIGS. 1 and 9, a driving frequency changer 160*b* included in an OLED display device 100 according to example embodiments may include a representative gray level calculating unit 163*b* that calculates a representative gray level of input image data IDAT, and a driving frequency changing unit 164*b* that receives the input image data IDAT at an input frame frequency IFF, and outputs output image data ODAT at a first output frame frequency OFF1, a second output frame frequency OFF2 or a third output frame frequency OFF3.

The representative gray level calculating unit 163*b* may calculate the representative gray level of input image data IDAT. In some example embodiments, the representative gray level calculating unit 163*b* may calculate, as the representative gray level of the input image data IDAT, an average value of gray levels of (a plurality of pixel data included in) the input image data IDAT, a maximum value of the gray levels of the input image data IDAT, a minimum value of the gray levels of the input image data IDAT, or a value extracted from the gray levels of the input image data IDAT.

The driving frequency changing unit 164*b* may output the output image data ODAT at the first output frame frequency OFF1 substantially the same as the input frame frequency IFF when the input image data IDAT do not represent the still image, and may output the output image data ODAT at the second output frame frequency OFF2 lower than the input frame frequency IFF for the low frequency driving time when the input image data represent the still image. Furthermore, after the low frequency driving time, the driving frequency changing unit 164*a* may output the output image data ODAT at the third output frame frequency OFF3 higher than the second output frame frequency OFF2 for the high frequency insertion time corresponding to the representative gray level calculated by the representative gray level calculating unit 163*b*. In some example embodiments, the driving frequency changing unit 164*b* may determine the high frequency insertion time as a first time when the representative gray level is within a high gray range (e.g., from a 100-gray level to a 255-gray level), may determine the high frequency insertion time as a second time shorter than the first time when the representative gray level is within a middle gray range (e.g., from a 30-gray level to a 99-gray level), and may determine the high frequency insertion time as a third time longer than the first time when the representative gray level is within a low gray range (e.g., from a 0-gray level to a 29-gray level). For example, a luminance decrease rate of a display panel 110 during the low frequency driving time in a case where the display panel 110 displays a high gray image may be greater than a luminance decrease rate of the display panel 110 during the low frequency driving time in a case where the display panel 110 displays a middle gray image, and thus the high frequency insertion time when the representative gray level is within the high gray range may be longer than the high frequency insertion time when the representative gray level is within the middle gray range. Still furthermore, a flicker may be prone to be perceived by a user when the display panel 110 displays a low gray image, and thus the high frequency insertion time when the representative gray level is within the low gray range may be relatively long.

Hereinafter, a method of operating the OLED display device 100 including the driving frequency changer 160*b* will be described below with reference to FIGS. 1, 9, 10 and 11.

Referring to FIGS. 1, 9 and 10, a panel driver 170 may receive the input image data IDAT at the input frame frequency IFF from a host processor (S320), and may determine whether the input image data IDAT represent the still image (S330).

When the input image data IDAT do not represent the still image (S330: NO), the panel driver 170 may drive the display panel 110 at the first output frame frequency OFF1 substantially the same as the input frame frequency IFF (S340).

When the input image data IDAT represent the still image (S330: YES), the panel driver 170 may calculate the representative gray level of input image data IDAT (S350). For example, the representative gray level calculating unit 163*b* included in the panel driver 170 may calculate, as the representative gray level of the input image data IDAT, the average value, the maximum value, the minimum value or any value extracted from the gray levels of the input image data IDAT.

The panel driver 170 may drive the display panel 110 at the second output frame frequency OFF2 lower than the input frame frequency IFF for the low frequency driving time (S360), and may drive the display panel 110 at the third output frame frequency OFF3 higher than the second output frame frequency OFF2 and lower than or equal to the first output frame frequency OFF1 for the high frequency insertion time corresponding to the representative gray level calculated by the representative gray level calculating unit 163*b* after the low frequency driving time (S370). In some example embodiments, the driving frequency changing unit 164*b* included in the display panel 110 may determine the high frequency insertion time according to whether the representative gray level is within the high gray range, the middle gray range or the low gray range. For example, as illustrated in FIG. 11, the driving frequency changing unit 164*b* may determine the high frequency insertion time as about 1 s when the representative gray level is within the high gray range from the 100-gray level 100G to the 255-gray level 255G, may determine the high frequency insertion time as about 0.5 s when the representative gray level is within the middle gray range from the 30-gray level 30G to the 99-gray level 99G, and may determine the high frequency insertion time as about 2 s when the representative gray level is within the low gray range from the 0-gray level 0G to the 29-gray level 29G. Accordingly, the luminance deterioration may be reduced or prevented even if the high gray image is displayed as the still image, and the flicker may be reduced or prevented even if the low gray image is displayed as the still image. In some example embodiments, driving the display panel 110 at the second output frame frequency OFF2 for the low frequency driving time and driving the display panel 110 at the third output frame frequency OFF3 for the high frequency insertion time may be repeated until the still image represented by the input image data IDAT are changed (S380).

As described above, in the method of operating the OLED display device 100 according to example embodiments, the high frequency insertion time may be determined according to the representative gray level of the input image data IDAT. Accordingly, power consumption may be reduced by low frequency driving, a threshold voltage shift may be sufficiently compensated, and the luminance deterioration and the flicker caused by the low frequency driving may be reduced or prevented.

FIG. 12 is a block diagram illustrating a driving frequency changer included in an OLED display device according to example embodiments.

Referring to FIGS. 1 and 12, a driving frequency changer 160*c* included in an OLED display device 100 according to example embodiments may include a high frequency insertion time storage 162*c* that stores a plurality of high frequency insertion times respectively corresponding to a plurality of gray ranges, a representative gray level calculating unit 163*c* that calculates a representative gray level of input image data IDAT, and a driving frequency changing unit 164*c* that receives input image data IDAT at an input frame frequency IFF, and outputs output image data ODAT at a first output frame frequency OFF1, a second output frame frequency OFF2 or a third output frame frequency OFFS.

The plurality of high frequency insertion times corresponding to the plurality of gray ranges stored in the high frequency insertion time storage 162*c* may be determined according to luminance decrease rates of a display panel 110 corresponding to the plurality of gray ranges during a low frequency driving time. For example, the high frequency insertion time storage 162*c* may store a first high frequency insertion time corresponding to a high gray range, a second high frequency insertion time corresponding to a middle gray range, and a third high frequency insertion time corresponding to a low gray range. Furthermore, for example, the first high frequency insertion time may be determined the luminance decrease rate of the display panel 110 during the low frequency driving time when a high gray image is displayed, the second high frequency insertion time may be determined the luminance decrease rate of the display panel 110 during the low frequency driving time when a middle gray image is displayed, and the third high frequency insertion time may be determined the luminance decrease rate of the display panel 110 during the low frequency driving time when a low gray image is displayed.

The representative gray level calculating unit 163*c* may calculate the representative gray level of the input image data IDAT. According to example embodiments, the representative gray level calculating unit 163*c* may calculate, as the representative gray level of the input image data IDAT, an average value, a maximum value, a minimum value or any value extracted from gray levels of the input image data IDAT.

The driving frequency changing unit 164*c* may output the output image data ODAT at the first output frame frequency OFF1 substantially the same as the input frame frequency IFF when the input image data IDAT do not represent the still image, and may output the output image data ODAT at the second output frame frequency OFF2 lower than the input frame frequency IFF for the low frequency driving time when the input image data represent the still image. Furthermore, after the low frequency driving time, the driving frequency changing unit 164*c* may output the output image data ODAT at the third output frame frequency OFF3 higher than the second output frame frequency OFF2 for a high frequency insertion time selected according to the representative gray level among the plurality of high frequency insertion times stored in the high frequency insertion time storage 162*c*. For example, the driving frequency changing unit 164*c* may output the output image data ODAT at the third output frame frequency OFF3 for the first high frequency insertion time when the representative gray level is within the high gray range, may output the output image data ODAT at the third output frame frequency OFF3 for the second high frequency insertion time when the representative gray level is within the middle gray range, and may output the output image data ODAT at the third output frame frequency OFF3 for the third high frequency insertion time when the representative gray level is within the low gray range. The data driver 120 may drive the display panel 110 at the first output frame frequency OFF1, the second output frame frequency OFF2 or the third output frame frequency OFF3 based on the output image data ODAT.

As described above, in the method of operating the OLED display device 100 according to example embodiments, the plurality of high frequency insertion times may be determined according to the panel characteristics of the display panel 110 corresponding to the plurality of gray ranges, and one of the plurality of high frequency insertion times may be selected according to the representative gray level of the input image data IDAT. Accordingly, power consumption may be reduced by low frequency driving, a threshold voltage shift may be sufficiently compensated, and luminance deterioration and a flicker caused by the low frequency driving may be reduced or prevented.

Figure 13:
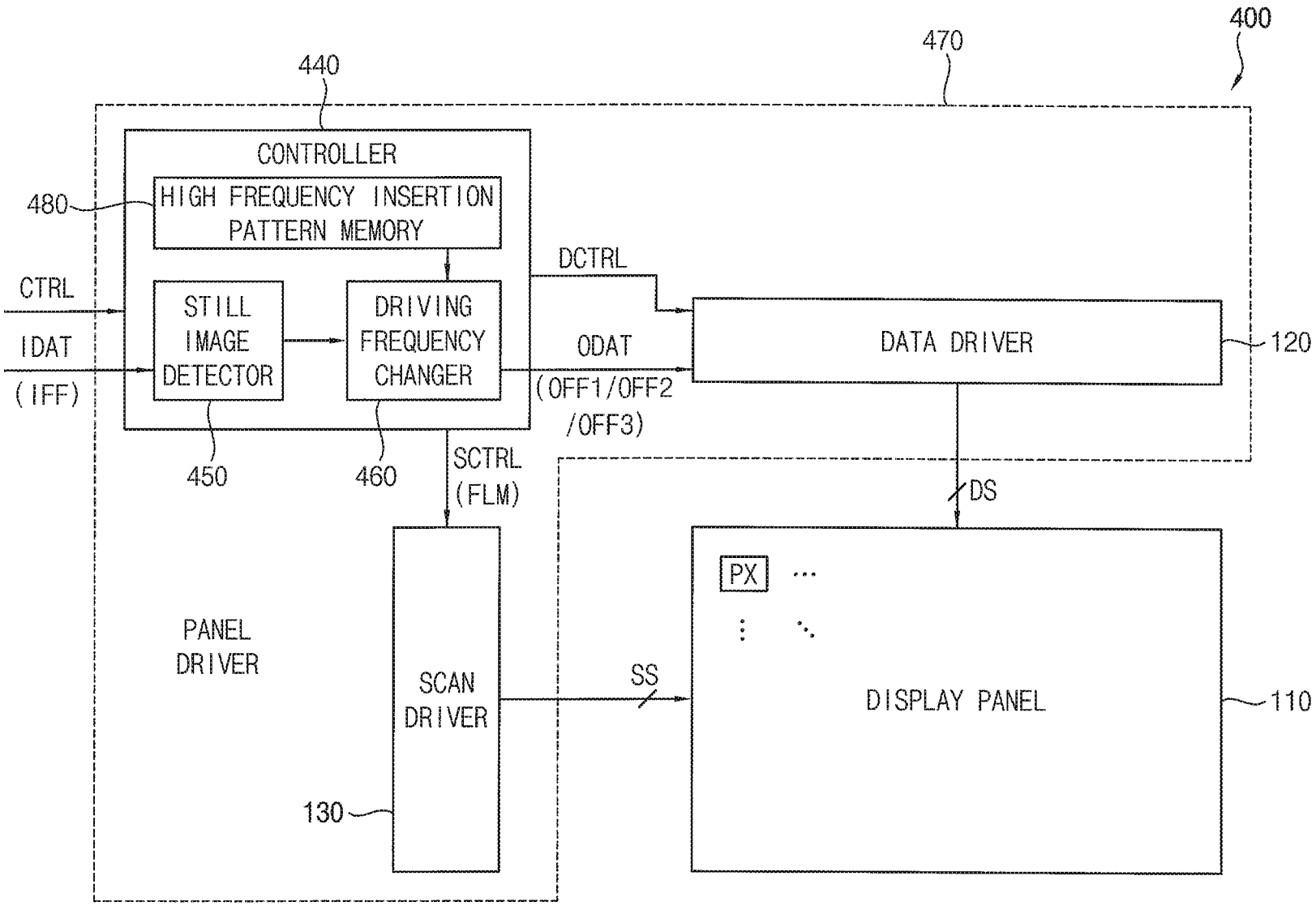
FIG. 13 is a block diagram illustrating an OLED display device according to example embodiments.

FIG. 13 is a block diagram illustrating an OLED display device according to example embodiments.

Referring to FIG. 13, an OLED display device 400 according to example embodiments may include a display panel 110 that includes a plurality of pixels PX each having an OLED, and a panel driver 470 that drives the display panel 110. In some example embodiments, the panel driver 470 may include a data driver 120, a scan driver 130, and a controller 440. The controller 440 may include a still image detector 450, a driving frequency changer 460, and a high frequency insertion pattern memory 480. The OLED display device 400 of FIG. 13 may have a similar configuration and a similar operation to an OLED display device 100 of FIG. 1, except that the controller 440 may further include the high frequency insertion pattern memory 480.

The high frequency insertion pattern memory 480 may store a high frequency insertion pattern that is determined according to a panel characteristic of the display panel 110. For example, the high frequency insertion pattern may be determined according to a luminance decrease rate of the display panel 110 when low frequency driving is performed. In some example embodiments, the high frequency insertion pattern may represent one or more frequencies higher than a frequency of the low frequency driving, and the respective numbers of frames for the one or more frequencies. In other example embodiments, the high frequency insertion pattern memory 480 may store a plurality of high frequency insertion patterns that are different from each other, and store pattern select information indicating a selected one of the plurality of high frequency insertion patterns.

The still image detector 450 may receive input image data IDAT at an input frame frequency IFF, and may determine whether the input image data IDAT represent a still image.

When the input image data IDAT do not represent the still image, the driving frequency changer 460 may output output image data ODAT at a first output frame frequency OFF1 substantially the same as the input frame frequency IFF, and the data driver 120 may drive the display panel 110 at the first output frame frequency OFF1 based on the output image data ODAT.

When the input image data IDAT represent the still image, the driving frequency changer 460 may output the output image data ODAT at a second output frame frequency OFF2 lower than the input frame frequency IFF for a low frequency driving time, and the data driver 120 may drive the display panel 110 at the second output frame frequency OFF2 based on the output image data ODAT. After the low frequency driving time, the driving frequency changer 460 may output the output image data ODAT based on the high frequency insertion pattern stored in the high frequency insertion pattern memory 480, and the data driver 120 may drive the display panel 110 corresponding to the high frequency insertion pattern based on the output image data ODAT. For example, the high frequency insertion pattern may represent at least one third output frame frequency OFF3 higher than the second output frame frequency OFF2 and lower than or equal to the first output frame frequency OFF1, and the number of frames for the third output frame frequency OFF3, and, after the low frequency driving time, the panel driver 470 may drive the display panel 110 at the third output frame frequency OFF3 represented by the high frequency insertion pattern for a time corresponding to the number of frames based on the high frequency insertion pattern. In some example embodiments, a threshold voltage shift of a plurality of driving transistors included in the plurality of pixels PX which occurs during the low frequency driving time may be compensated while the display panel 110 is driven at the third output frame frequency OFF3 higher than the second output frame frequency OFF2 based on the high frequency insertion pattern.

As described above, in the OLED display device 400 according to example embodiments, in a case where the input image data IDAT represent the still image, the display panel 110 may be driven at the second output frame frequency OFF2 lower than the input frame frequency IFF for the low frequency driving time, and, after the low frequency driving time, the display panel 110 may be driven based on the high frequency insertion pattern determined according to the panel characteristic of the display panel 110. Accordingly, luminance deterioration and a flicker caused by low frequency driving may be reduced or prevented, and the high frequency insertion suitable for each display panel 110 may be performed.

Figure 14:
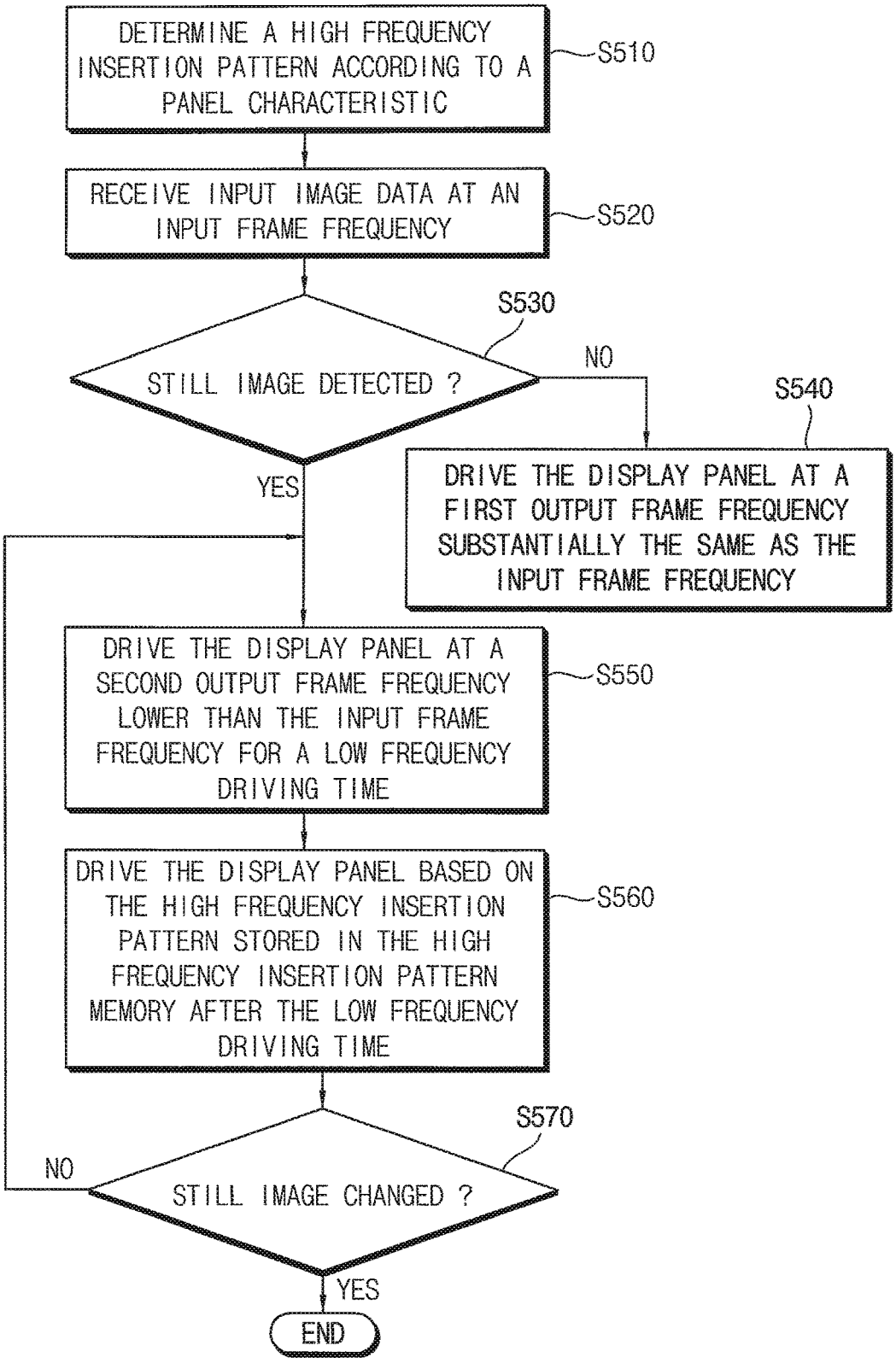
FIG. 14 is a flowchart illustrating a method of operating an OLED display device according to example embodiments.
Figure 16:
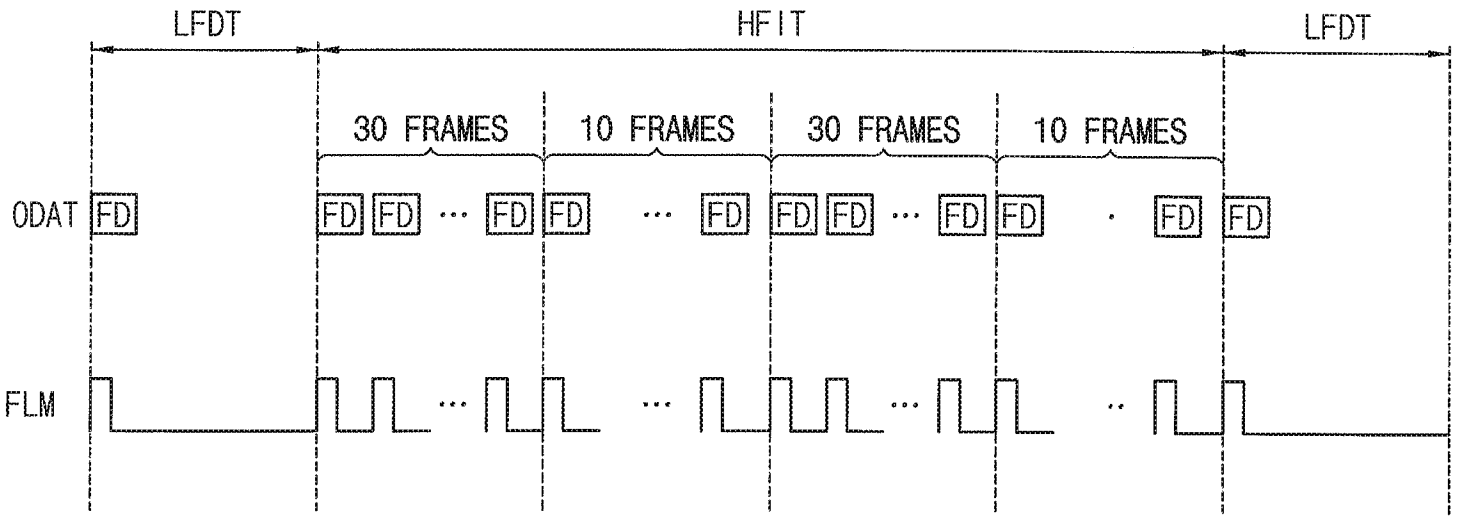
FIG. 16 is a timing diagram for describing an example where a display panel is driven based on a high frequency insertion pattern of FIG. 15.
Figure 17:
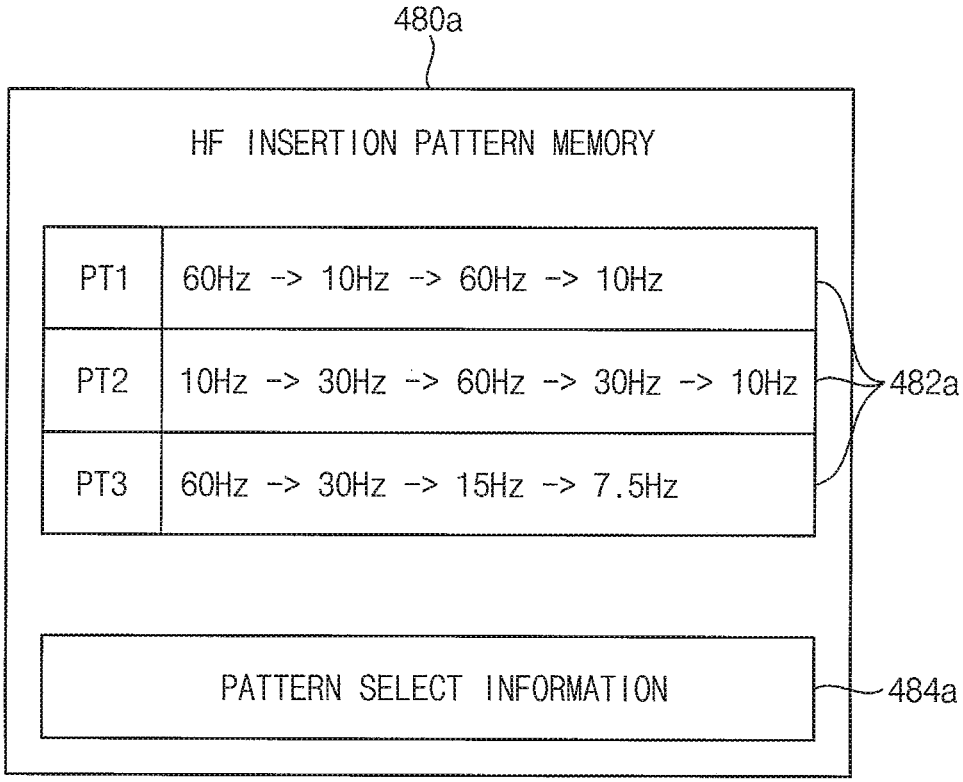
FIG. 17 is a diagram illustrating an example of a high frequency insertion pattern memory included in an OLED display device according to example embodiments.

FIG. 14 is a flowchart illustrating a method of operating an OLED display device according to example embodiments, FIG. 15 is a diagram illustrating an example of a high frequency insertion pattern stored in a high frequency insertion pattern memory included in an OLED display device according to example embodiments, FIG. 16 is a timing diagram for describing an example where a display panel is driven based on a high frequency insertion pattern of FIG. 15, and FIG. 17 is a diagram illustrating an example of a high frequency insertion pattern memory included in an OLED display device according to example embodiments.

Referring to FIGS. 13 and 14, a high frequency insertion pattern may be determined according to a panel characteristic of a display panel 110, and the determined high frequency insertion pattern may be stored in a high frequency insertion pattern memory 480 (S510). In an example, the high frequency insertion pattern stored in the high frequency insertion pattern memory 480 may include, as illustrated in FIG. 15, at least one frequency OFF3 higher than a frequency of low frequency driving, and the number of frames (# of frames) for each frequency. In other example embodiments, as illustrated in FIG. 17, the high frequency insertion pattern memory 480*a* may store a plurality of high frequency insertion patterns 482*a* that are different from each other, and pattern select information 484*a* indicating a selected one of the plurality of high frequency insertion patterns 482*a*.

A panel driver 470 may receive input image data IDAT at an input frame frequency IFF from a host processor (S520), and may determine whether the input image data IDAT represent a still image (S530).

When the input image data IDAT do not represent the still image (S530: NO), the panel driver 470 may drive the display panel 110 at a first output frame frequency OFF1 substantially the same as the input frame frequency IFF (S540).

When the input image data IDAT represent the still image (S530: YES), the panel driver 470 may drive the display panel 110 at a second output frame frequency OFF2 lower than the input frame frequency IFF for a low frequency driving time (S550), and may drive the display panel 110 based on the high frequency insertion pattern stored in the high frequency insertion pattern memory 480 after the low frequency driving time (S560).

For example, in a case where the high frequency insertion pattern illustrated in FIG. 15 is stored in the high frequency insertion pattern memory 480, or in a case where the high frequency insertion pattern representing a first pair of about 30 Hz and a frame number of 30, a second pair of about 10 Hz and a frame number of 10, a third pair of about 30 Hz and a frame number of 30 and a fourth pair of about 10 Hz and a frame number of 10 is stored in the high frequency insertion pattern memory 480, after the low frequency driving time, the panel driver 470 may drive the display panel 110 at a third output frame frequency OFF3 for a time corresponding to the frame number based on the high frequency insertion pattern. That is, as illustrated in FIG. 16, after the low frequency driving time LFDT, the panel driver 470 may output frame data FD of thirty frames at the third output frame frequency OFF3 of about 30 Hz as output image data ODAT based on the first pair of about 30 Hz and the frame number of 30, and thus the display panel 110 may be driven at the third output frame frequency OFF3 of about 30 Hz for about one second. Then, the panel driver 470 may output frame data FD of ten frames at the third output frame frequency OFF3 of about 10 Hz as the output image data ODAT based on the second pair of about 10 Hz and the frame number of 10, and thus the display panel 110 may be driven at the third output frame frequency OFF3 of about 10 Hz for about one second. Then, the panel driver 470 may output frame data FD of thirty frames at the third output frame frequency OFF3 of about 30 Hz as the output image data ODAT based on the third pair of about 30 Hz and the frame number of 30, and thus the display panel 110 may be driven at the third output frame frequency OFF3 of about 30 Hz for about one second. Then, the panel driver 470 may output frame data FD of ten frames at the third output frame frequency OFF3 of about 10 Hz as the output image data ODAT based on the fourth pair of about 10 Hz and the frame number of 10, and thus the display panel 110 may be driven at the third output frame frequency OFF3 of about 10 Hz for about one second. As described above, after the low frequency driving time LFDT, the display panel 110 may be driven based on the high frequency insertion pattern stored in the high frequency insertion pattern memory 480. The low frequency driving time LFDT and a high frequency insertion time HFIT in which the display panel 110 is driven based on the high frequency insertion pattern may be repeated until the still image represented by the input image data IDAT are changed (S570).

In another example, as illustrated in FIG. 17, the high frequency insertion pattern memory 480*a* may store the plurality of high frequency insertion patterns 482*a* and the pattern select information 484*a*. After the low frequency driving time, the panel driver 470 may drive the display panel 110 based on a selected high frequency insertion pattern indicated by the pattern select information 484*a* among the plurality of high frequency insertion patterns 482*a*. For example, as illustrated in FIG. 17, the high frequency insertion pattern memory 480*a* may store a first high frequency insertion pattern PT1 representing a first pair of about 60 Hz and a corresponding frame number, a second pair of about 10 Hz and a corresponding frame number, a third pair of about 60 Hz and a corresponding frame number and a fourth pair of about 10 Hz and a corresponding frame number, a second high frequency insertion pattern PT2 representing a first pair of about 10 Hz and a corresponding frame number, a second pair of about 30 Hz and a corresponding frame number, a third pair of about 60 Hz and a corresponding frame number, a fourth pair of about 30 Hz and a corresponding frame number and a fifth pair of about 10 Hz and a corresponding frame number, and a third high frequency insertion pattern PT3 representing a first pair of about 60 Hz and a corresponding frame number, a second pair of about 30 Hz and a corresponding frame number, a third pair of about 15 Hz and a corresponding frame number and a fourth pair of about 7.5 Hz and a corresponding frame number. In a case where the pattern select information 484*a* indicates the second high frequency insertion pattern PT2 among the first through third high frequency insertion patterns PT1, PT2, and PT3, the panel driver 470 may drive the display panel 110 in an order of about 10 Hz, about 30 Hz, about 60 Hz, about 30 Hz, and about 10 Hz after the low frequency driving time.

Figure 18:
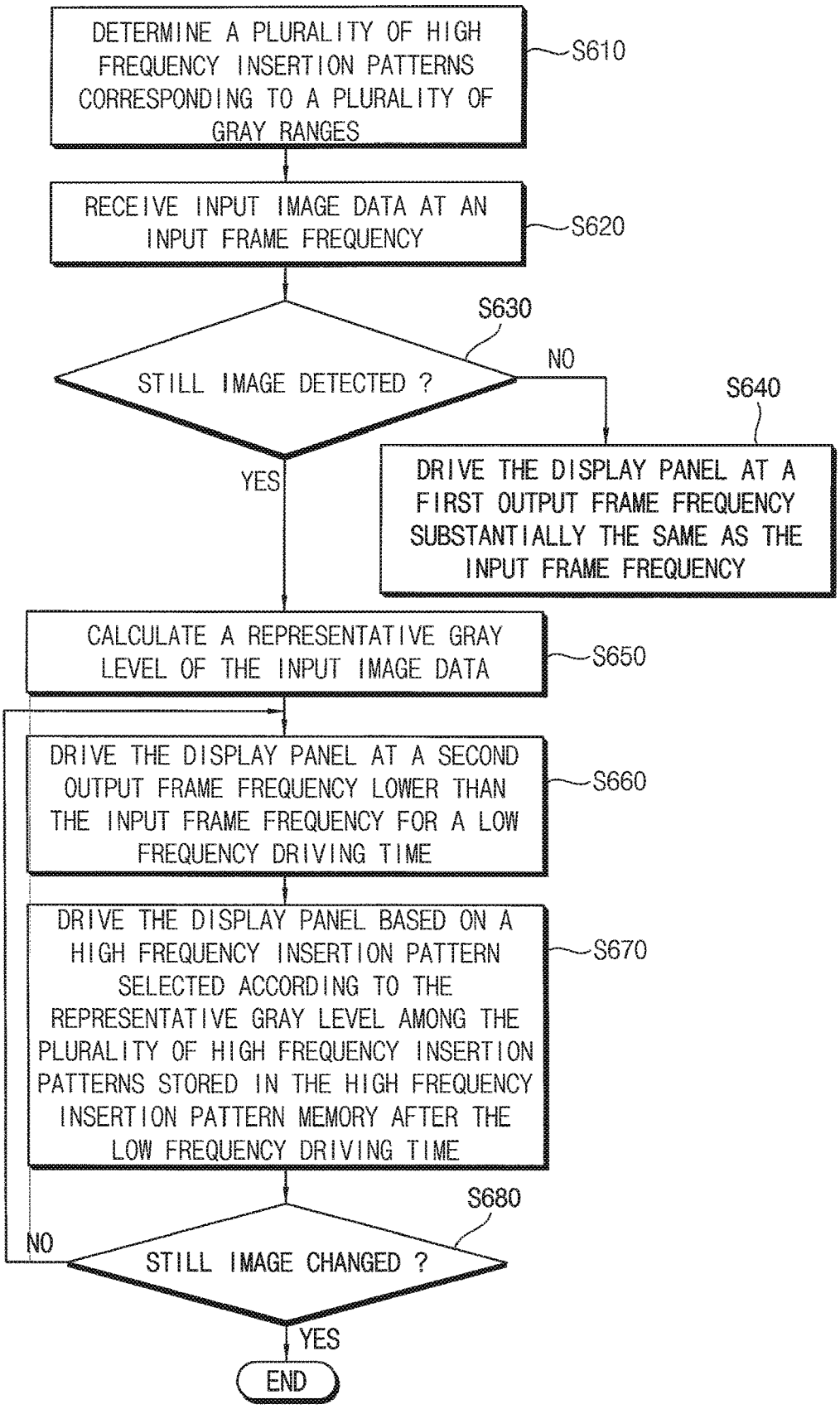
FIG. 18 is a flowchart illustrating a method of operating an OLED display device according to example embodiments.

FIG. 18 is a flowchart illustrating a method of operating an OLED display device according to example embodiments, and FIG. 19 is a diagram illustrating an example of a plurality of high frequency insertion patterns respectively corresponding to a plurality of gray ranges.

Referring to FIGS. 13 and 18, a plurality of high frequency insertion patterns corresponding to a plurality of gray ranges may be determined according to panel characteristics of a display panel 110 corresponding to the plurality of gray ranges, and the plurality of high frequency insertion patterns corresponding to the plurality of gray ranges may be stored in a high frequency insertion pattern memory 480 (S610). For example, as illustrated in FIG. 19, the high frequency insertion pattern memory 480 may store a first high frequency insertion pattern corresponding to a high gray range from a 100-gray level 100G to a 255-gray level 255G, a second high frequency insertion pattern corresponding to a middle gray range from a 30-gray level 30G to a 99-gray level 99G, and a third high frequency insertion pattern corresponding to a low gray range from a 0-gray level 0G to a 29-gray level 29G.

A panel driver 470 may receive input image data IDAT at an input frame frequency IFF from a host processor (S620), and may determine whether the input image data IDAT represent a still image (S630).

When the input image data IDAT do not represent the still image (S630: NO), the panel driver 470 may drive the display panel 110 at a first output frame frequency OFF1 substantially the same as the input frame frequency IFF (S640).

When the input image data IDAT represent the still image (S630: YES), the panel driver 470 may calculate a representative gray level of the input image data IDAT (S650). For example, a representative gray level calculating unit included in the panel driver 470 may calculate, as the representative gray level of the input image data IDAT, an average value, a maximum value, a minimum value or any value extracted from gray levels of the input image data IDAT.

The panel driver 470 may drive the display panel 110 at a second output frame frequency OFF2 lower than the input frame frequency IFF for a low frequency driving time (S660), and may drive the display panel 110 based on a high frequency insertion pattern selected according to the representative gray level among the plurality of high frequency insertion patterns stored in the high frequency insertion pattern memory 480 after the low frequency driving time (S670). For example, in a case where the high frequency insertion pattern memory 480 stores the first through third high frequency insertion patterns as illustrated in FIG. 19, and the representative gray level is within the high gray range, the panel driver 470 may drive the display panel 110 in an order of about 30 Hz, about 10 Hz, about 30 Hz and about 10 Hz after the low frequency driving time. Furthermore, in a case where the representative gray level is within the middle gray range, the panel driver 470 may drive the display panel 110 in an order of about 30 Hz and about 10 Hz after the low frequency driving time. Still furthermore, in a case where the representative gray level is within the low gray range, the panel driver 470 may drive the display panel 110 in an order of about 30 Hz, about 20 Hz and about 10 Hz after the low frequency driving time. In some example embodiments, driving the display panel 110 at the second output frame frequency OFF2 for the low frequency driving time and driving the display panel 110 based on the high frequency insertion pattern may be repeated until the still image represented by the input image data IDAT are changed (S680).

Figure 20:
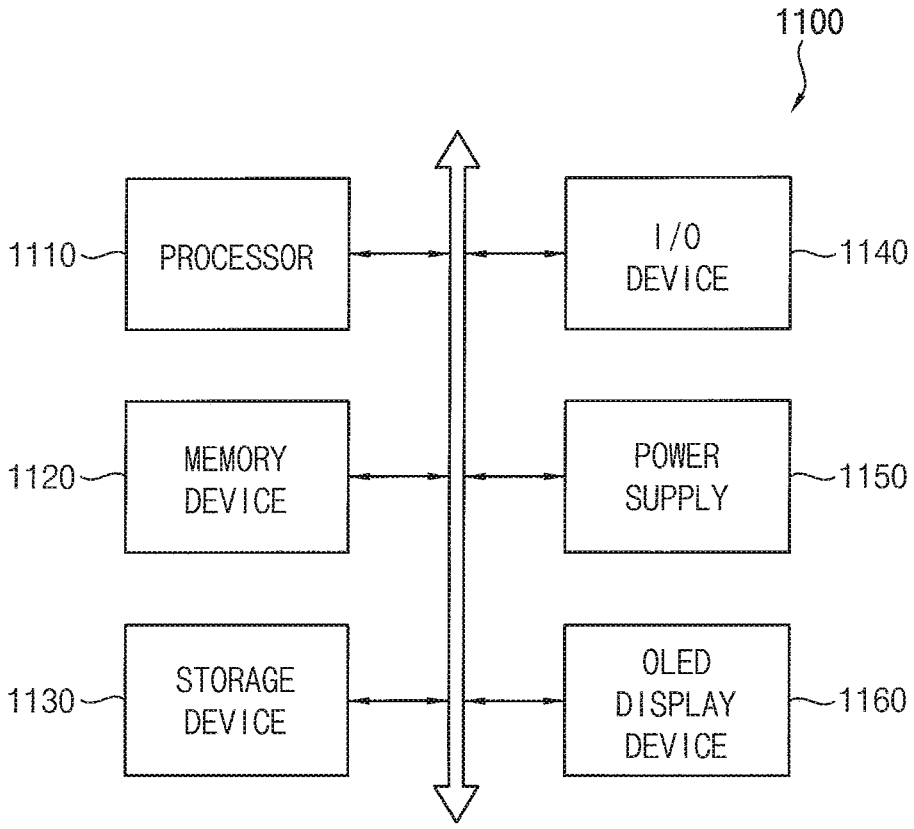
FIG. 20 is an electronic device including a display device according to example embodiments.

FIG. 20 is an electronic device including a display device according to example embodiments.

Referring to FIG. 20, an electronic device 1100 may include a processor 1110, a memory device 1120, a storage device 1130, an input/output (I/O) device 1140, a power supply 1150, and an OLED display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc.

Furthermore, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The OLED display device 1160 may be coupled to other components through the buses or other communication links.

The OLED display device 1160 may determine whether input image data represent a still image. When the input image data represent the still image, the OLED display device 1160 may drive a display panel at an output frame frequency lower than an input frame frequency for a low frequency driving time, and may drive the display panel at a frequency higher than the output frame frequency for a high frequency insertion time after the low frequency driving time. Accordingly, a threshold voltage shift of a plurality of driving transistors which occurs during the low frequency driving time may be compensated during the high frequency insertion time, thereby reducing or preventing luminance deterioration and a flicker. Furthermore, the high frequency insertion time may be determined based on at least one of a panel characteristic of the display panel and a representative gray level of the input image data, and thus high frequency insertion suitable for each display panel may be performed.

The present disclosure may be applied to any OLED display device 1160, and any electronic device 1100 including the OLED display device 1160. For example, the inventive concepts may be applied to a mobile phone, a smart phone, a wearable electronic device, a tablet computer, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present disclosure. Accordingly, all such modifications are intended to be included within the scope of the present disclosure as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device comprising:

a display panel including a plurality of pixels; and a panel driver configured to drive the display panel, wherein the panel driver receives an input image data and determines whether the input image data represent a still image, and wherein, when the input image data represent the still image, the panel driver drives the display panel at a first frame frequency for a first time to display the still image, and drives the display panel at a second frame frequency higher than the first frame frequency for a second time after the first time to display the still image.

2. The display device of claim 1, wherein the second time is determined based on at least one of a panel characteristic of the display panel and a representative gray level of the input image data.

3. The display device of claim 1, wherein a threshold voltage shift of a plurality of driving transistors included in the plurality of pixels which occurs during the first time is compensated during the second time.

4. The display device of claim 1, wherein the second time is periodically inserted while the still image represented by the input image data is not changed.

5. The display device of claim 1, wherein each of the plurality of pixels includes:

a driving transistor configured to generate a driving current;

a switching transistor configured to transfer a data signal to a source of the driving transistor;

a compensating transistor configured to diode-connect the driving transistor;

a storage capacitor configured to store the data signal transferred through the switching transistor and the diode-connected driving transistor;

a first initializing transistor configured to provide an initialization voltage to the storage capacitor and a gate of the driving transistor in response to an initialization signal;

a first emission controlling transistor configured to connect a line of a power supply voltage to the source of the driving transistor in response to an emission control signal;

a second emission controlling transistor configured to connect a drain of the driving transistor to a light emitting element in response to the emission control signal;

a second initializing transistor configured to provide the initialization voltage to the light emitting element in response to the first scan signal; and the light emitting element configured to emit light based on the driving current, and wherein at least one of the driving transistor, the switching transistor, the compensating transistor, the first initializing transistor, the first emission controlling transistor the second emission controlling transistor and the second initializing transistor is implemented with a P-type Metal Oxide Semiconductor (PMOS) transistor, and at least one of the driving transistor, the switching transistor, the compensating transistor, the first initializing transistor, the first emission controlling transistor, the second emission controlling transistor and the second initializing transistor is implemented with an N-type Metal Oxide Semiconductor (NMOS) transistor.

6. The display device of claim 1, wherein each of the plurality of pixels includes:

a driving transistor configured to generate a driving current;

a first switching transistor configured to transfer a data signal;

a storage capacitor configured to store the data signal transferred through the first switching transistor;

a second switching transistor configured to connect the storage capacitor and the driving transistor to an initialization line;

an emission controlling transistor configured to connect a line of a power supply voltage to the driving transistor; and a light emitting element configured to emit light based on the driving current, and wherein at least one of the driving transistor, the first switching transistor, the second switching transistor and the emission controlling transistor is implemented with a P-type Metal Oxide Semiconductor (PMOS) transistor, and at least one of the driving transistor, the first switching transistor, the second switching transistor and the emission controlling transistor is implemented with an N-type Metal Oxide Semiconductor (NMOS) transistor.

7. The display device of claim 1, wherein the panel driver includes:

a still image detector configured to determine whether the input image data represent the still image by comparing the input image data in a previous frame and the input image data in a current frame.

8. The display device of claim 1, wherein the second time is determined according to, as a panel characteristic of the display panel, a luminance decrease rate of the display panel during the first time.

9. The display device of claim 1, wherein the panel driver includes:

a driving frequency changer comprising:

a high frequency insertion time storage configured to store the second time that is determined according to a luminance decrease rate of the display panel during the first time; and a driving frequency changing unit configured to output an image data at the first frame frequency for the first time when the input image data represent the still image, and to output the output image data at the second frame frequency for the second time stored in the high frequency insertion time storage after the first time, and a data driver configured to provide data signals to the plurality of pixels based on the output image data.

10. The display device of claim 1, wherein the second time is determined according to, as a representative gray level of the input image data, an average value, a maximum value, or a minimum value of gray levels of the input image data.

11. The display device of claim 1, wherein the panel driver includes:

a representative gray level calculating unit configured to calculate a representative gray level of the input image data;

a driving frequency changing unit configured to output an output image data at the first frame frequency for the first time when the input image data represent the still image, and to output the output image data at the second frame frequency for the second time corresponding to the representative gray level calculated by the representative gray level calculating unit after the first time; and a data driver configured to provide data signals to the plurality of pixels based on the output image data.

12. The display device of claim 11, wherein the driving frequency changing unit determines the second time as a third time when the representative gray level is within a high gray range, wherein the driving frequency changing unit determines the second time as a fourth time shorter than the third time when the representative gray level is within a middle gray range, and wherein the driving frequency changing unit determines the second time as a fifth time longer than the third time when the representative gray level is within a low gray range.

13. The display device of claim 1, wherein the panel driver includes:

a high frequency insertion time storage configured to store a plurality of high frequency insertion times respectively corresponding to a plurality of gray ranges, the plurality of high frequency insertion times being determined according to luminance decrease rates of the display panel corresponding to the plurality of gray ranges during the first time;

a representative gray level calculating unit configured to calculate a representative gray level of the input image data;

a driving frequency changing unit configured to output an output image data at the first frame frequency for the first time when the input image data represent the still image, and to output the output image data at the second frame frequency for the second time selected according to the representative gray level among the plurality of high frequency insertion times stored in the high frequency insertion time storage after the first time; and a data driver configured to provide data signals to the plurality of pixels based on the output image data.

14. A display device comprising:

a display panel including a plurality of pixels; and a panel driver configured to drive the display panel, the panel driver including:

a high frequency insertion pattern memory configured to store a high frequency insertion pattern that is determined according to a panel characteristic of the display panel, wherein the panel driver receives an input image data, and determines whether the input image data represent a still image, and wherein, when the input image data represent the still image, the panel driver drives the display panel at a first frame frequency for a first time to display the still image, and drives the display panel based on the high frequency insertion pattern after the first time to display the still image.

15. The display device of claim 14, wherein a threshold voltage shift of a plurality of driving transistors included in the plurality of pixels which occurs during the first time is compensated while the display panel is driven based on the high frequency insertion pattern.

16. The display device of claim 14, wherein the high frequency insertion pattern stored in the high frequency insertion pattern memory represent at least one second frame frequency higher than the first frame frequency, and a number of frames for the second frame frequency, and wherein, after the first time, the panel driver drives the display panel at the second frame frequency for a second time corresponding to the number of frames based on the high frequency insertion pattern.

17. The display device of claim 16, wherein the second frame frequency is lower than or equal to an input frame frequency of the input image data.

18. The display device of claim 14, wherein the high frequency insertion pattern memory stores a plurality of high frequency insertion patterns that are different from each other, and the high frequency insertion pattern is one of the plurality of high frequency insertion patterns, wherein the high frequency insertion pattern memory further stores pattern select information indicating a selected one of the plurality of high frequency insertion patterns, and wherein, after the first time, the panel driver drives the display panel based on the selected one of the plurality of high frequency insertion patterns.

19. The display device of claim 14, wherein the high frequency insertion pattern memory stores a plurality of high frequency insertion patterns respectively corresponding to a plurality of gray ranges, the high frequency insertion pattern is one of the plurality of high frequency insertion patterns, and the plurality of high frequency insertion patterns are determined according to luminance decrease rates of the display panel corresponding to the plurality of gray ranges during the first time.

20. The display device of claim 19, wherein the panel driver further includes:

a representative gray level calculating unit configured to calculate a representative gray level of the input image data;

a driving frequency changing unit configured to output an output image data at the first frame frequency for the first time when the input image data represent the still image, and to output the output image data based on the high frequency insertion pattern selected according to the representative gray level among the plurality of high frequency insertion patterns stored in the high frequency insertion pattern memory after the first time; and a data driver configured to provide data signals to the plurality of pixels based on the output image data.

* * * * *